US008081126B2

(12) United States Patent
Ikeda et al.

(10) Patent No.: US 8,081,126 B2
(45) Date of Patent: Dec. 20, 2011

(54) ANTENNA APPARATUS

(75) Inventors: Masakazu Ikeda, Warabi (JP); Yusuke Tainaka, Warabi (JP)

(73) Assignee: Nippon Antena Kabushiki Kaisha, Tokyo (JP)

( * ) Notice: Subject to any disclaimer, the term of this patent is extended or adjusted under 35 U.S.C. 154(b) by 703 days.

(21) Appl. No.: 12/179,568

(22) Filed: Jul. 24, 2008

(65) Prior Publication Data

US 2009/0207084 A1 Aug. 20, 2009

Related U.S. Application Data

(63) Continuation-in-part of application No. 11/852,319, filed on Sep. 9, 2007, now abandoned.

(30) Foreign Application Priority Data

Nov. 22, 2006 (JP) ..... 2006-315297

(51) Int. Cl.
*H01Q 1/32* (2006.01)

(52) U.S. Cl. ..... 343/713; 343/700 MS

(58) Field of Classification Search ..... 343/711, 343/713, 700 MS
See application file for complete search history.

(56) References Cited

U.S. PATENT DOCUMENTS

| | | | | |
|---|---|---|---|---|
| 6,714,164 | B2 * | 3/2004 | Shimizu | 343/715 |
| 7,283,100 | B2 * | 10/2007 | Thompson et al. | 343/713 |
| 7,436,362 | B2 * | 10/2008 | Noro | 343/700 MS |
| 2006/0227057 | A1 | 10/2006 | Lu | |

FOREIGN PATENT DOCUMENTS

| | | | |
|---|---|---|---|
| EP | 0 989 629 | A1 | 3/2000 |
| EP | 1 291 967 | A1 | 3/2003 |
| JP | A-04-369902 | | 12/1992 |
| JP | A-2000-078044 | | 3/2000 |
| JP | A-2003-017916 | | 1/2003 |
| JP | A-2003-124719 | | 4/2003 |
| JP | A-2003-133841 | | 5/2003 |
| JP | U-3112014 | | 6/2005 |
| WO | WO 03/098735 | A1 | 11/2003 |
| WO | WO 2006/061218 | A1 | 6/2006 |

OTHER PUBLICATIONS

Mar. 3, 2008 European Search Report issued in EP 07 01 8839.
Feb. 5, 2008 International Search Report issued in PCT/JP2007/072360.
Nov. 19, 2009 Office Action issued in U.S. Appl. No. 11/852,319.

* cited by examiner

*Primary Examiner* — Tan Ho
(74) *Attorney, Agent, or Firm* — Oliff & Berridge, PLC

(57) ABSTRACT

Even though an antenna apparatus is low profile to have a height of not more than 70 mm, sensitivity is maximally suppressed from being deteriorated. In an antenna case 10 projecting from a vehicle in a height of not more than 70 mm, an antenna circuit board 30 on which an antenna pattern is formed is uprightly arranged and an amplifier circuit board 34 which amplifies a received signal output from the antenna circuit board 30 are housed. In the antenna circuit board 30, an antenna coil to resonate the antenna pattern in an FM wave-band is inserted between the antenna pattern and a feeding point. Therefore, a low-profile antenna pattern having a length which is about 1/20 a wavelength of an FM broadcast resonates the FM band.

10 Claims, 33 Drawing Sheets line A-A sectional view line b1-b1 sectional view line b2-b2 sectional view line b3-b3 sectional view line b4-b4 sectional view line b5-b5 sectional view line b6-b6 sectional view line b7-b7 sectional view line b8-b8 sectional view line b9-b9 sectional view line b10-b10 sectional view line b11-b11 sectional view line b12-b12 sectional view line b13-b13 sectional view

ANTENNA APPARATUS

This application is a Continuation-in-Part of U.S. Non-provisional application Ser. No. 11/852,319 filed on Sep. 9, 2007 now abandoned; which claims priority to Japanese Patent Application No. 2006-315297, filed on Nov. 22, 2006, the contents of which are all herein incorporated by this reference in their entireties. All publications, patents, patent applications, databases and other references cited in this application, all related applications referenced herein, and all references cited therein, are incorporated by reference in their entirety as if restated here in full and as if each individual publication, patent, patent application, database or other reference were specifically and individually indicated to be incorporated by reference.

TECHNICAL FIELD

The present invention relates to an antenna apparatus which can be attached to a vehicle which can receive at least FM broadcast.

BACKGROUND ART

As a prior antenna apparatus attached to a vehicle, an antenna apparatus which can receive AM broadcast and FM broadcast is generally used. In this antenna apparatus, a rod antenna having a length of about 1 m is used to receive the AM broadcast and the FM broadcast. The length of the antenna is considerably short for a wavelength in an AM waveband although the wavelength is ¼ wavelength in an FM waveband. For this reason, the sensitivity of the antenna is especially deteriorated. Therefore, an impedance of the rod antenna is made high for the AM waveband, or an amplifier for the AM waveband is used to assure a high sensitivity. Furthermore, a vehicle antenna apparatus in which a helical antenna obtained by helically winding an antenna rod portion to shorten an antenna length to about 180 mm to 400 mm is also used. However, an amplifier is arranged immediately below the antenna to compensate for the deterioration of performance caused by the shortening of the rod portion.

A configuration in which a prior antenna apparatus 401 having a rod portion is attached to a vehicle 402 is shown in FIG. 41. As shown in FIG. 41, the prior antenna apparatus 401 is attached on the roof of the vehicle 402. A height h10 of the antenna apparatus 401 projecting from the vehicle 402 is set at about 200 mm. The rod portion of the antenna apparatus 401 is a helical antenna obtained by helically winding an antenna. Since the antenna apparatus 401 projects from the vehicle 402 as described above, the rod portion may collide to be broken in shedding or washing of the vehicle. Therefore, an antenna apparatus in which the rod portion of the antenna apparatus 401 can be bent along the roof of the vehicle 402 is also known.

[Patent Document 1] Japanese Publication Unexamined Patent Application No. 2005-223957

[Patent Document 2] Japanese Publication Unexamined Patent Application No. 2003-188619

DISCLOSURE OF THE INVENTION

Problem that the Invention is Intended to Solve

In a prior antenna apparatus 401, since the rod portion largely projects from the vehicle body, the beauty and design of the vehicle are spoiled. Furthermore, when the rod portion bent in shading or washing of the vehicle is forgotten to be raised, the antenna performance is disadvantageously kept lost. In addition, since the antenna apparatus 401 is exposed to the outside of the antenna apparatus 401, the rod portion is in danger of being stolen. Therefore, a vehicle antenna apparatus in which an antenna is housed in an antenna case may be conceived. In this case, the height of the antenna apparatus projecting from the vehicle is limited 70 mm or less due to the regulation of a vehicle-outside projection, and a lateral direction of the antenna apparatus is preferably set at about 160 to 220 mm not to spoil the beauty of the vehicle. In this case, a radial resistance R rad of such a small antenna is approximately determined in proportion to the square of the height as expressed as 600 to 800×(height/wavelength) 2. For example, when the antenna height is reduced from 180 mm to 60 mm, the sensitivity of the antenna is reduced by about 10 dB. In this manner, when an existing rod antenna is simply shortened, the performance is considerably deteriorated to make it difficult to practically use the antenna. Furthermore, when the antenna is made low-profile to have a height of 70 mm or less, the radial resistance R rad decreases. Therefore, radiation efficiency is easily deteriorated owing of conductor loss of the antenna itself to cause further deterioration of sensitivity.

Therefore, it is an object of the present invention to provide an antenna apparatus which is low-profile in a height of 70 mm or less while being suppressed as much as possible in deterioration of sensitivity, can be attached to a vehicle, and can receive at least FM broadcast.

Means for Solving the Problem

In order to achieve the object, the present invention provides an antenna apparatus which includes an antenna case projecting from a vehicle in a height of not more than 70 mm and an antenna unit housed in the antenna case, wherein, in the antenna unit, an antenna coil is inserted between an antenna formed by an antenna pattern and an amplifier.

Effect of the Invention

According to the present invention, the antenna apparatus includes the antenna case projecting from a vehicle in a height of not more than 70 mm and an antenna unit housed in the antenna case. In the antenna unit, an antenna coil is inserted between the antenna formed by the antenna pattern and the amplifier, and deterioration of the sensitivity can be suppressed by an operation of the antenna coil even though the antenna case is low-profile in the height of not more than 70 mm.

BEST MODE FOR CARRYING OUT THE INVENTION

Figure 1:
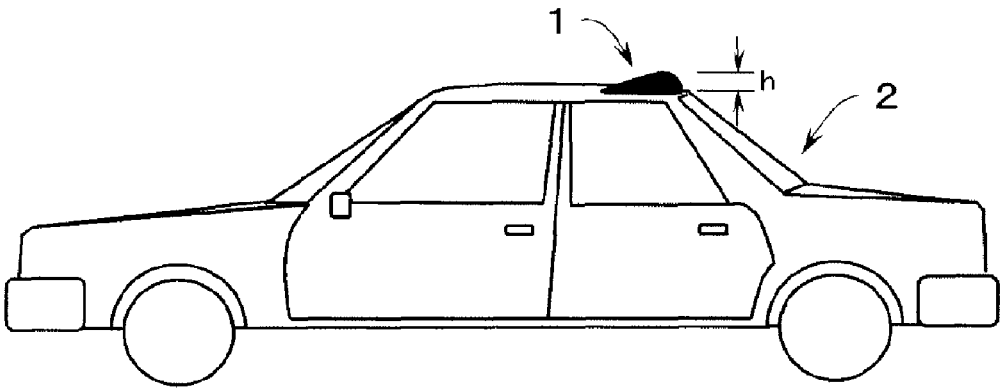
FIG. 1 is a diagram showing a configuration of a vehicle to which an antenna apparatus for vehicle according to a first embodiment of the present invention.

A configuration of a vehicle to which an antenna apparatus for vehicle according to the first embodiment of the present invention is attached is shown in FIG. 1. As shown in FIG. 1, an antenna apparatus 1 according to the first embodiment of the present invention is attached to the roof of a vehicle 2. A height h of the antenna apparatus 1 projecting from the vehicle 2 is set at 70 mm or less. The antenna apparatus 1 according to the first embodiment has an antenna case (will be described later) and is very low-profile (when a wavelength at a frequency of 100 MHz is represented by λ, the height h is about 0.0023λ). However, the antenna apparatus 1 can receive AM broadcast and FM broadcast. The shape of the antenna apparatus 1 is streamlined to be tapered toward the distal end. The shape can be freely determined within a certain range not to spoil the beauty and design of the vehicle. A lower surface of the antenna apparatus 1 has a shape matched with a surface of an attaching surface of the vehicle 2 and watertightly attached to the vehicle 2.

Figure 2:
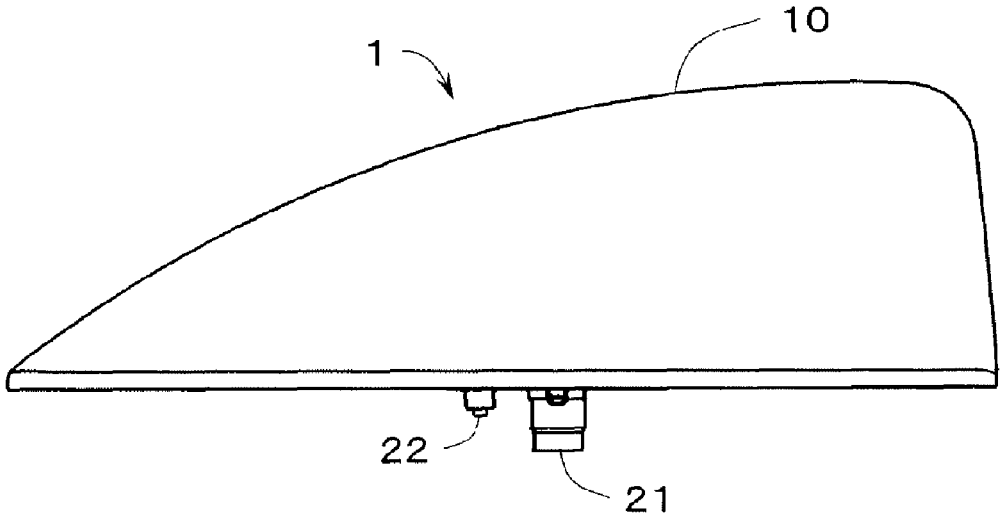
FIG. 2 is a side view showing a configuration of the antenna apparatus according to the first embodiment of the present invention.
Figure 3:
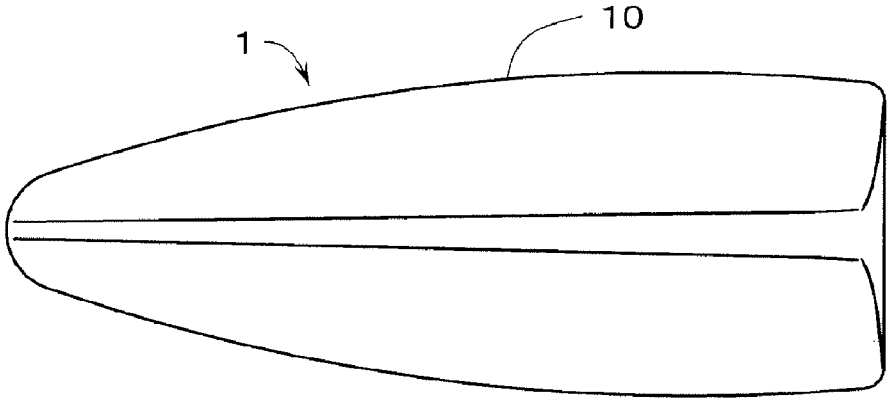
FIG. 3 is a plan view showing a configuration of the antenna apparatus according to the first embodiment of the present invention.
Figure 4:
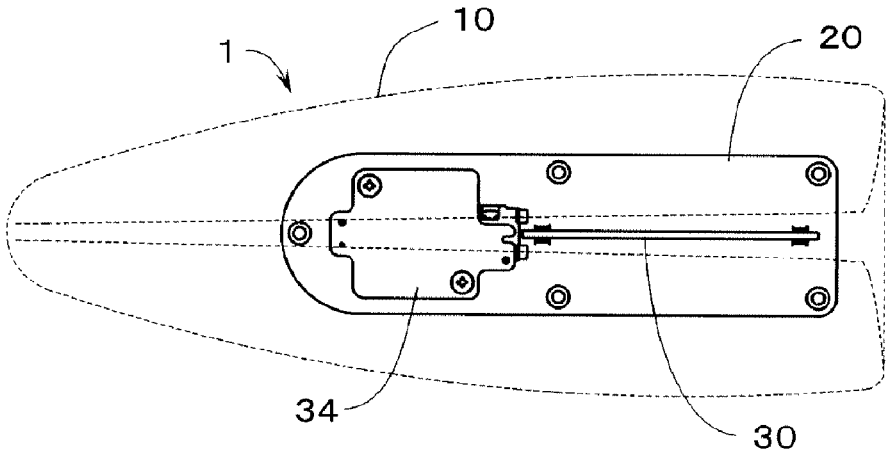
FIG. 4 is a plan view showing an internal configuration of the antenna apparatus according to the first embodiment of the present invention.
Figure 5:
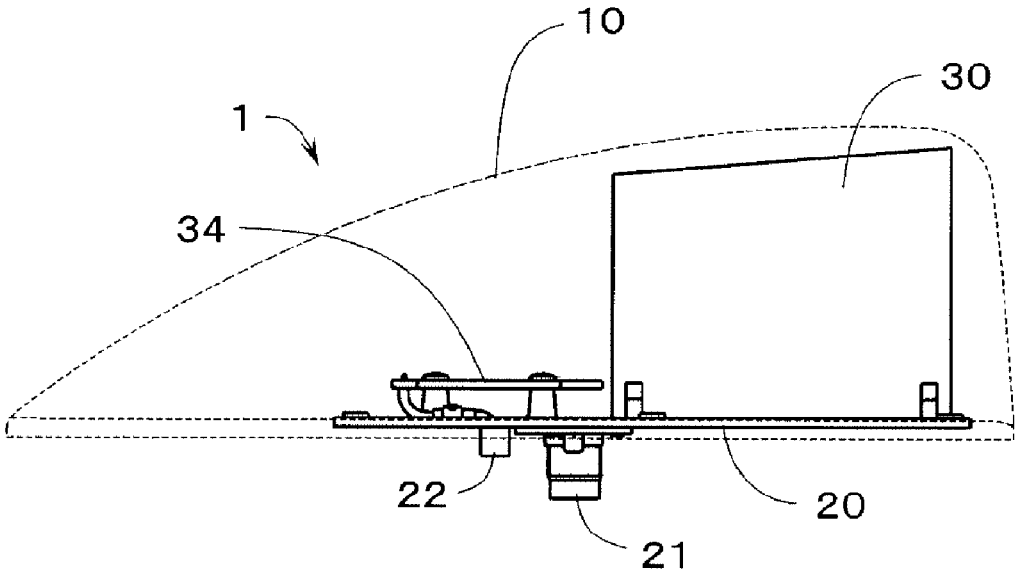
FIG. 5 is a side view showing an internal configuration of the antenna apparatus according to the first embodiment of the present invention.

A configuration of the antenna apparatus 1 for vehicle according to the first embodiment of the present invention is shown in FIGS. 2 to 5. FIG. 2 is a side view showing a configuration of the antenna apparatus 1 according to the present invention. FIG. 3 is a plan view showing a configuration of the antenna apparatus 1 according to the present invention. FIG. 4 is a plan view showing an internal configuration of the antenna apparatus 1 according to the present invention. FIG. 5 is a side view showing an internal configuration of the antenna apparatus 1 according to the present invention.

As shown in these drawings, the antenna apparatus 1 according to the first embodiment of the present invention includes: an antenna case 10; an antenna base 20 housed in the antenna case 10; and an antenna circuit board 30 and an amplifier circuit board 34 which are attached to the antenna base 20. A longitudinal length of the antenna case 10 is set at about 200 mm, and a lateral width is set at about 75 mm.

The antenna case 10 consists of a radiowave transmitting synthetic resin and has a streamlined outer shape which is tapered toward the distal end. A lower surface of the antenna case 10 has a shape matched with a shape of an attaching surface of the vehicle 2. In the antenna case 10, a space in which the antenna circuit board 30 can be uprightly housed and a space in which the amplifier circuit board 34 can be horizontally housed are formed. A metal antenna base 20 is attached to the lower surface of the antenna case 10. The antenna circuit board 30 is uprightly fixed to the antenna base 20, and the amplifier circuit board 34 is fixed beside the antenna circuit board 30. For this reason, the metal antenna base 20 is attached to the lower surface of the antenna case 10 to make it possible to house the antenna circuit board 30 and the amplifier circuit board 34 in the space of the antenna case 10. An upper edge of the uprightly fixed antenna circuit board 30 has a shape matched with a shape of the internal space of the antenna case 10, and the height of the antenna circuit board 30 is preferably set as largely as possible.

From the lower surface of the antenna base 20, a bolt portion 21 to attach the antenna apparatus 1 to the vehicle 2 and a cable drawing port 22 from which a cable to guide a received signal from the antenna apparatus 1 into the vehicle 2 are formed to project. In this case, holes into which the bolt portion 21 and the cable drawing port 22 are formed in the roof of the vehicle 2. The antenna apparatus 1 is placed on the roof such that the bolt portion 21 and the cable drawing port 22 are inserted into the holes. A nut is fastened to the bolt portion 21 projecting into the vehicle 2 to make it possible to fix the antenna apparatus 1 on the roof of the vehicle 2. At this time, a cable drawn from the cable drawing port 22 also serving as a positioning projection is guided into the vehicle 2. A feeding cable for the amplifier circuit board 34 housed in the antenna case 10 is guided into the antenna case 10 through the cable drawing port 22.

Figure 6:
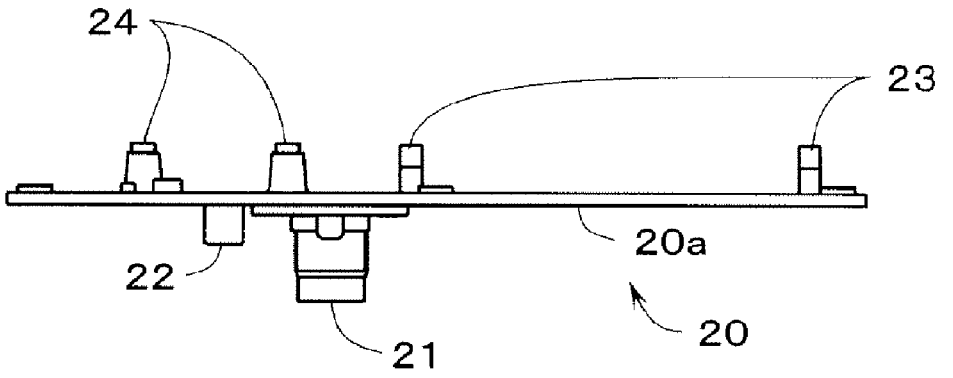
FIG. 6 is a front view showing a configuration of an antenna base of the antenna apparatus according to the first embodiment of the present invention.
Figure 7:
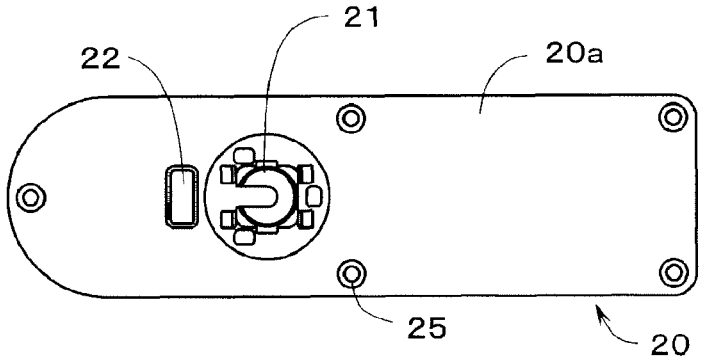
FIG. 7 is a lower diagram showing a configuration of the antenna base of the antenna apparatus according to the first embodiment of the present invention.
Figure 8:
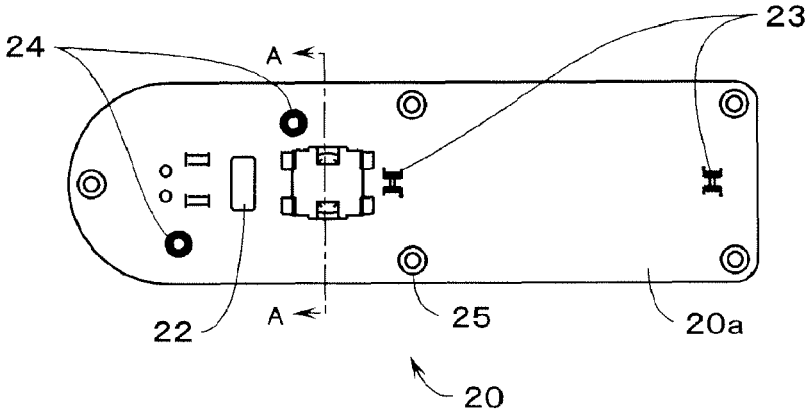
FIG. 8 is a plan view showing the configuration of the antenna base of the antenna apparatus according to the first embodiment of the present invention.
Figure 9:
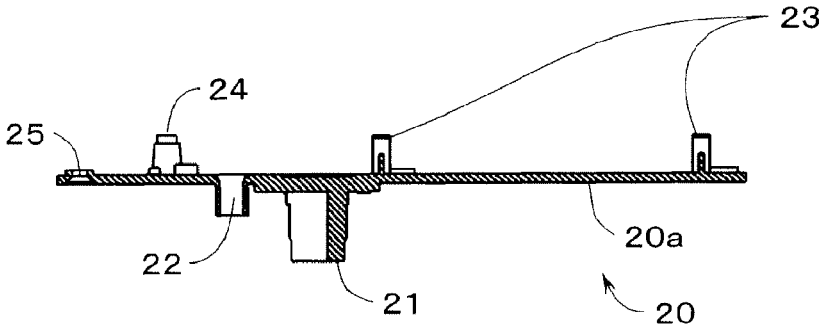
FIG. 9 is a sectional view obtained by cutting the configuration of the antenna base of the antenna apparatus according to the first embodiment of the present invention along a longitudinal center line.
Figure 10:
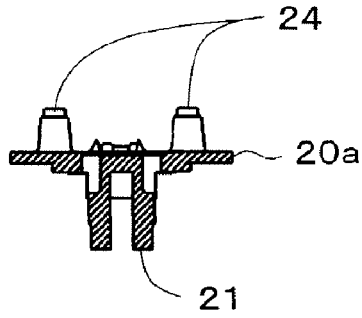
FIG. 10 is a sectional view obtained by cutting showing the configuration of the antenna base of the antenna apparatus according to the first embodiment of the present invention along an A-A line.

In this case, a configuration of the antenna base 20 is shown in FIGS. 6 to 10. However, FIG. 6 is a front view showing a configuration of the antenna base 20, FIG. 7 is a lower diagram showing a configuration of the antenna base 20 of the antenna apparatus, FIG. 8 is a plan view showing the configuration of the antenna base 20, FIG. 9 is a sectional view obtained by cutting the configuration of the antenna base 20 along a longitudinal center line, and FIG. 10 is a sectional view obtained by cutting the configuration of the antenna base 20 along an A-A line.

As shown in these drawings, the antenna base 20 has a base plate 20*a* constituted by a nearly rectangular flat plate having a semicircular shape in one side, and one pair of circuit board fixing portions 23 which uprightly holds the antenna circuit board 30 by holding an edge portion of the antenna circuit board 30 between the circuit board fixing portions 23 are formed on an upper surface of the base plate 20*a*. Furthermore, one pair of bosses 24 which support the amplifier circuit board 34 by screw fixation are formed to project. Five attaching holes 25 through which screws for attaching the antenna base 20 to the antenna case 10 are connected are formed in a peripheral edge of the base plate 20*a*. Furthermore, in a rear surface of the base plate 20*a*, the bolt portion 21 screw-cut in the peripheral side surface and the cable drawing port 22 having a nearly rectangular section are formed to project. In this manner, as shown in FIGS. 4 and 5, the antenna circuit board 30 is uprightly fixed to the pair of circuit board fixing portions 23, and the amplifier circuit board 34 is fixed to the pair of bosses 24. The feeding point formed on the antenna circuit board 30 is connected to an input of the amplifier circuit board 34 are connected by a cable, and a cable connected to an output from the amplifier circuit board 34 is drawn downward from the cable drawing port 22.

Figure 11:
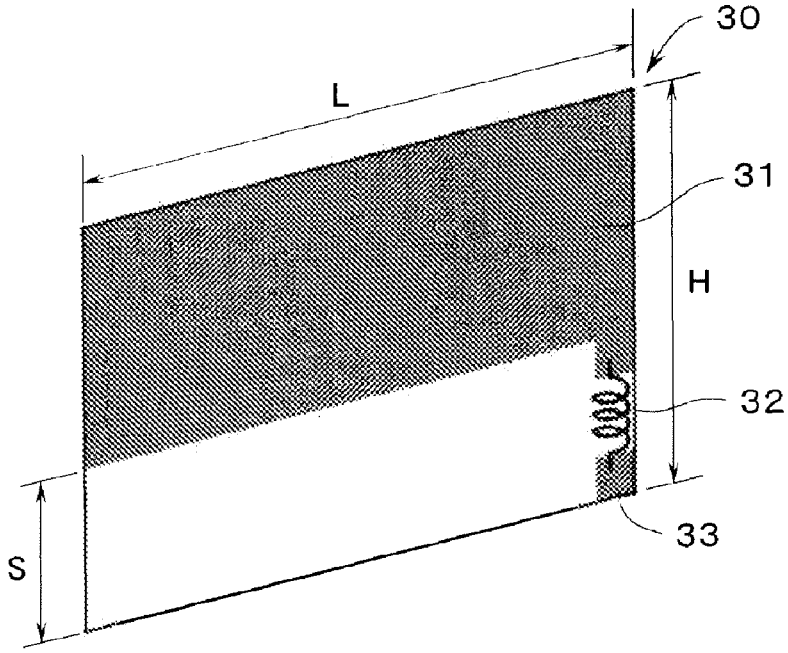
FIG. 11 is a perspective view showing a configuration of an antenna circuit board of the antenna apparatus according to the first embodiment of the present invention.

A perspective view showing a configuration of the antenna circuit board 30 is shown in FIG. 11. The antenna circuit board 30 shown in FIG. 11 is a printed circuit board such as a glass epoxy circuit board having a good high-frequency characteristic. An antenna pattern 31 constituting an antenna and a pattern of a feeding point 33 are formed on the antenna circuit board 30. A height and a length of the antenna circuit board 30 are represented by H and L, respectively, and an interval between the antenna circuit board 30 and the lower edge of the antenna pattern 31 is represented by S. The antenna pattern 31 is formed on an upper half of the antenna circuit board 30 like one plate to constitute a plate-like antenna. A length and a height of the antenna pattern 31 are represented by L and (H-S), respectively. In this manner, the plate-like antenna is formed on the antenna circuit board 30 for the following reasons. Due to limitation of the size of the antenna case 10, it is difficult to set the height H and the length L of the antenna pattern 31 at about 60 mm or more and about 90 mm or more, respectively. In this case, when a wavelength at a frequency of 100 MHz in an FM waveband is represented by λ, a size when the height H is about 60 mm is 0.02λ, and a size when the length L is about 90 mm is 0.03λ. As a result an antenna formed by the antenna pattern 31 serves as a very small antenna with respect to a wavelength λ.

In the very small antenna, since an inductor component obtained by the antenna pattern 31 decreases, the antenna pattern 31 cannot be resonated in the FM waveband. Therefore, a conductor line length may be increased as an antenna pattern obtained by folding and bending a line pattern. However, since a conductor loss increases in accordance with the increase in conductor line length, the antenna deteriorates in electric characteristic. Therefore, in order to reduce the conductor loss as much as possible, the pattern is simplified to obtain the antenna pattern 31 which has a plate-like shape as shown in FIG. 11.

However, since the plate-like antenna formed by the antenna pattern 31 shown in FIG. 11 is very small with respect to the wavelength λ, the inductor component becomes close to zero. In addition, an antenna capacity of the plate-like antenna is about 1 pF to 3 pF. Therefore, an antenna coil 32 having 1 μH to 3 μH is inserted in series with the feeding point 33 near the feeding point 33, so that an antenna unit constituted by the antenna pattern 31 and the antenna coil 32 can be resonated in almost the FM waveband. In this manner, the antenna unit constituted by the antenna pattern 31 and the antenna coil 32 can be preferably operated in the FM waveband. The antenna resonated in the FM waveband is used as a voltage receiving element in the AM waveband to make it possible to receive a signal in the AM waveband.

Figure 13:
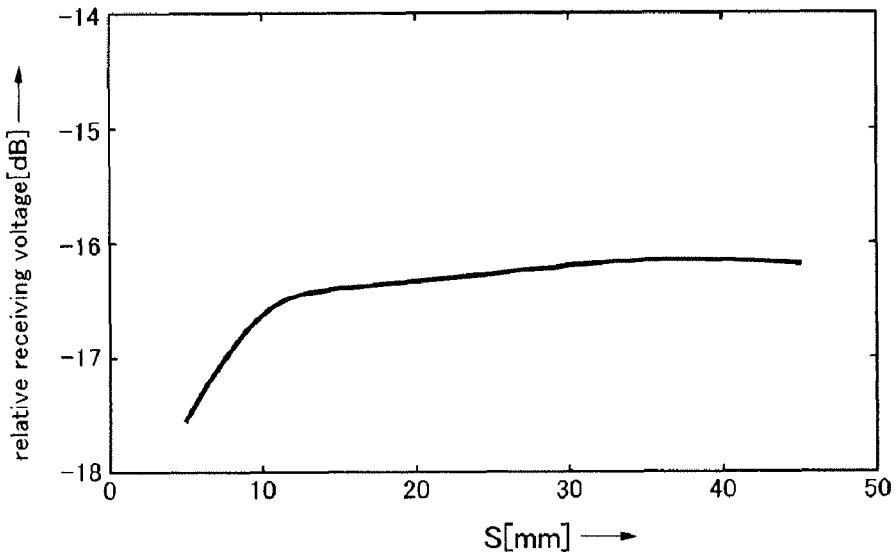
FIG. 13 is a graph of a relative receiving voltage in an AM waveband in the antenna apparatus according to the first embodiment of the present invention.

In this case, in the antenna pattern 31 shown in FIG. 11, by using the interval S which is a distance from the ground and shown in FIG. 11 as a parameter, a graph of a relative [dB] received voltage in the AM waveband obtained at the feeding point 33 is shown in FIG. 13. The received voltage is a relative received voltage in the AM waveband excited by a metal rod having a length of 400 mm is set at 0 dB. The interval S from the ground is substantially equal to the interval with the metal antenna base 20. With reference to FIG. 13, until the interval S is gradually increased to about 10 mm, the received voltage sharply increases. However, when the interval S exceeds about 10 mm, the received voltage is almost saturated to moderately increase. This is because characteristics in the AM waveband deteriorate due to a capacitance between the ground and the antenna pattern 31 when the interval S is small. For this reason, it is preferable that the interval S between the antenna pattern 31 and the ground is set at about 10 mm or more.

Figure 12:
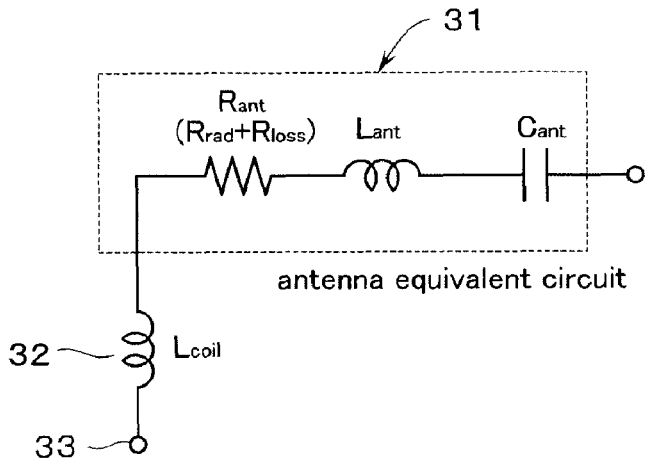
FIG. 12 is a circuit diagram showing an equivalent circuit of an antenna circuit board of the antenna apparatus according to the first embodiment of the present invention.

An equivalent circuit diagram of an antenna circuit board is shown in FIG. 12. As shown in FIG. 12, the equivalent circuit of the antenna pattern 31 is expressed by a serial connection circuit including an antenna capacitor C ant, an inductor component L ant, and an antenna resistor R ant. The antenna coil (L coil) 32 is connected in series with the serial circuit. More specifically, resonance occurs in almost an FM waveband by the antenna capacitor C ant, the inductor component L ant, and the antenna coil (L coil) 32. The antenna resistor R ant is a sum of a radial resistance R rad and a conductive resistor R loss of the antenna pattern 31. As the conductive resistor R loss is low, the radiant efficiency of the plate-like antenna formed by the antenna pattern 31 is improved. In this case, since the antenna pattern 31 is plate-like, the conductive resistor R loss becomes low to make it possible to improve radiant efficiency.

Figure 14:
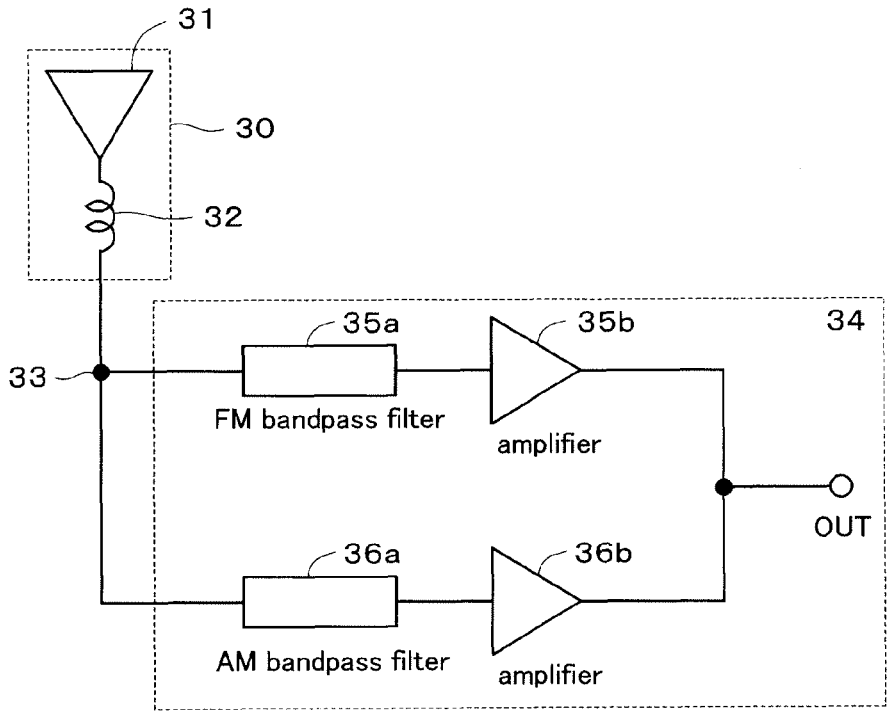
FIG. 14 is a circuit diagram of an equivalent circuit of the antenna apparatus according to the first embodiment of the present invention.

An equivalent circuit diagram of the antenna apparatus 1 according to the first embodiment of the present invention is shown in FIG. 14. In FIG. 14, the antenna unit is constituted by the antenna pattern 31 formed on the antenna circuit board 30 and the antenna coil 32 inserted between the antenna pattern 31 and the feeding point 33. A received signal of the antenna unit is input to the amplifier circuit board 34. On the amplifier circuit board 34, an FM bandpass filter 35*a* which separates the received signal into a received signal in the FM waveband and a received signal in the AM waveband, an AM bandpass filter 36*a*, and amplifiers 35*b* and 36*b* which amplify the received signal in the FM waveband and the received signal in the AM waveband, respectively are arranged. The received signal in the FM waveband extracted by the FM bandpass filter 35*a* is amplified by the amplifier 35*b*, and the received signal in the AM waveband extracted by the AM bandpass filter 36*a* is amplified by the amplifier 36*b*. An output from the amplifier 35*b* and the amplifier 36*b* are coupled and output from an output terminal OUT.

Since the feeding point 33 can be matched with an input impedance of the amplifier circuit board 34 by conjugative matching, resonance is not necessarily obtained by the antenna coil 32 within the FM waveband. In this case, when the conjugative matching can be achieved by making the impedance of the feeding point 33 capacitive and making an input to the amplifier circuit board 34 capacitive, the number of turns of the antenna coil 32 can be made small.

A gain characteristic in an FM waveband of the antenna apparatus 1 according to the first embodiment including the antenna unit constituted by the antenna pattern 31 and the antenna coil 32 which are formed on the antenna circuit board 30 shown in FIG. 11 and a gain characteristic of a prior antenna.

Figure 15:
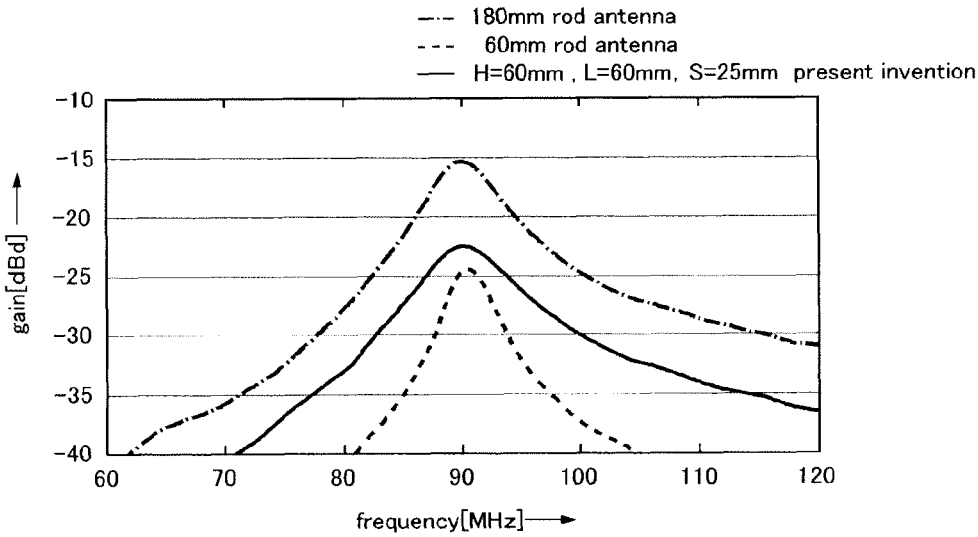
FIG. 15 is a graph showing a gain characteristic in an FM waveband of the antenna apparatus according to the first embodiment of the present invention together with a gain characteristic of a conventional antenna.
Figure 41:
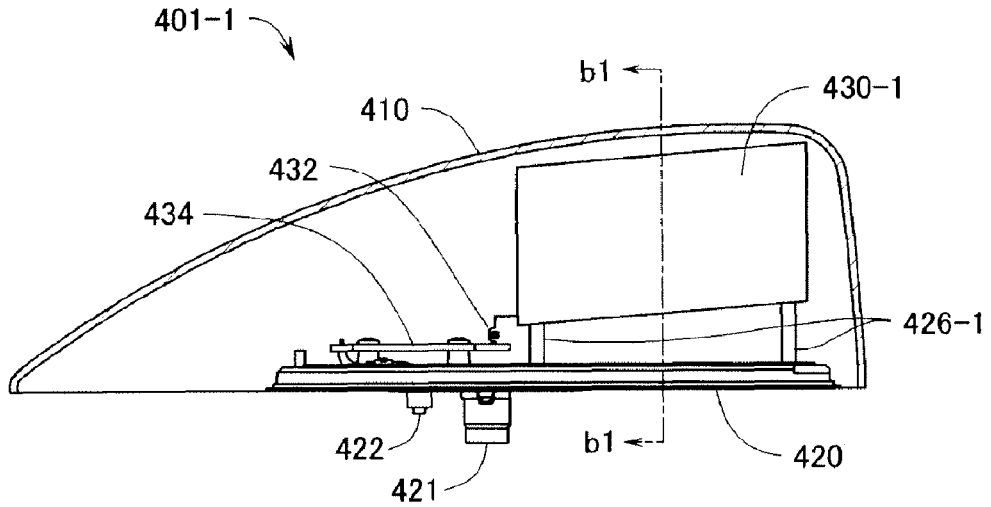
FIG. 41 is a side view showing the configuration of the antenna apparatus according to the fifth embodiment of the present invention.

In FIG. 15, an ordinate indicates a gain [dBd] such that a gain of a dipole antenna having a half wavelength is set at 0 dB. A gain characteristic indicated by an alternate long and short dash line is a gain characteristic obtained when a rod portion of the prior antenna apparatus 401 shown in FIG. 41 is set at 180 mm, and a gain characteristic indicated by a broken line is a gain characteristic obtained when the rod portion of the prior antenna apparatus 401 shown in FIG. 41 has a height of about 60 mm. The antenna apparatus 1 according to the first embodiment of the present invention indicated by a solid line in FIG. 15 has a gain characteristic in an FM waveband when both the height H and the length L of the antenna pattern 31 are set at 60 mm and the interval S from the ground is set at about 25 mm. As is apparent from FIG. 15, even though the antenna pattern 31 is made low-profile to have a height H of 60 mm, a gain which is larger than a gain of the prior antenna apparatus 401 having the 60-mm rod portion by about 3 dB or more can be obtained. Furthermore, the antenna apparatus 401 having the 60-mm rod portion has a sharp frequency characteristic and a narrow band. For this reason, it is difficult to obtain preferable matching over the entire FM waveband. However, since the antenna apparatus 1 according to the first embodiment of the present invention has a wide band almost equal to that of the prior antenna apparatus 401 having a 180-mm rod portion, matching with the amplifier circuit board 34 can be easily achieved.

Figure 16:
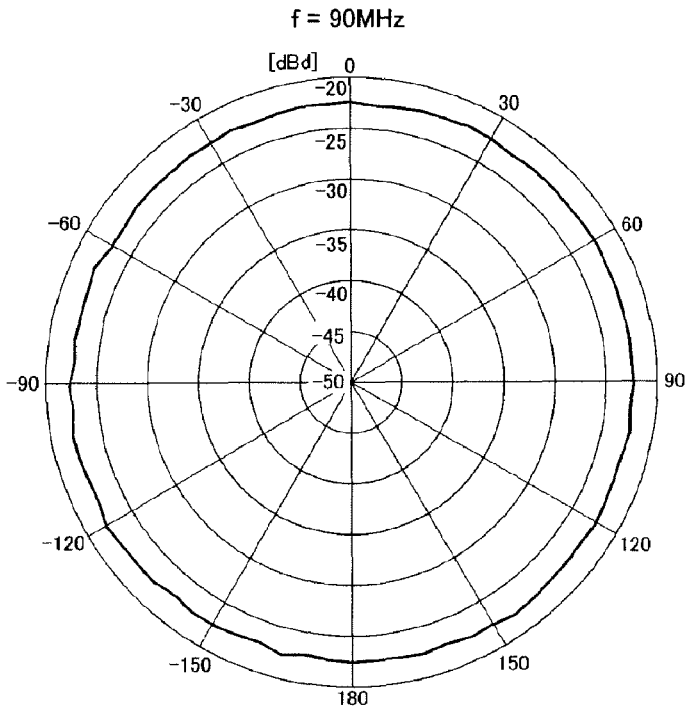
FIG. 16 is a graph showing an in-horizontal-plane directional pattern obtained when a frequency f of the antenna apparatus according to the first embodiment of the present invention is set at 90 MHz.

An in-horizontal-plane directional pattern obtained when a frequency f of the antenna apparatus 1 according to the first embodiment having the antenna unit constituted by the antenna pattern 31 and the antenna coil 32 which are formed on the antenna circuit board 30 shown in FIG. 11 is set at 90 MHz. As is apparent from FIG. 16, the in-horizontal directional pattern of the antenna apparatus 1 according to the first embodiment of the present invention is almost a non-directional pattern, and the antenna apparatus 1 can receive FM broadcast regardless of the direction of the vehicle 2. This is because the directional pattern is the non-direction pattern since the antenna pattern 31 is very small with respect to a wavelength although the antenna pattern 31 has an upright plate-like shape.

Figure 17:
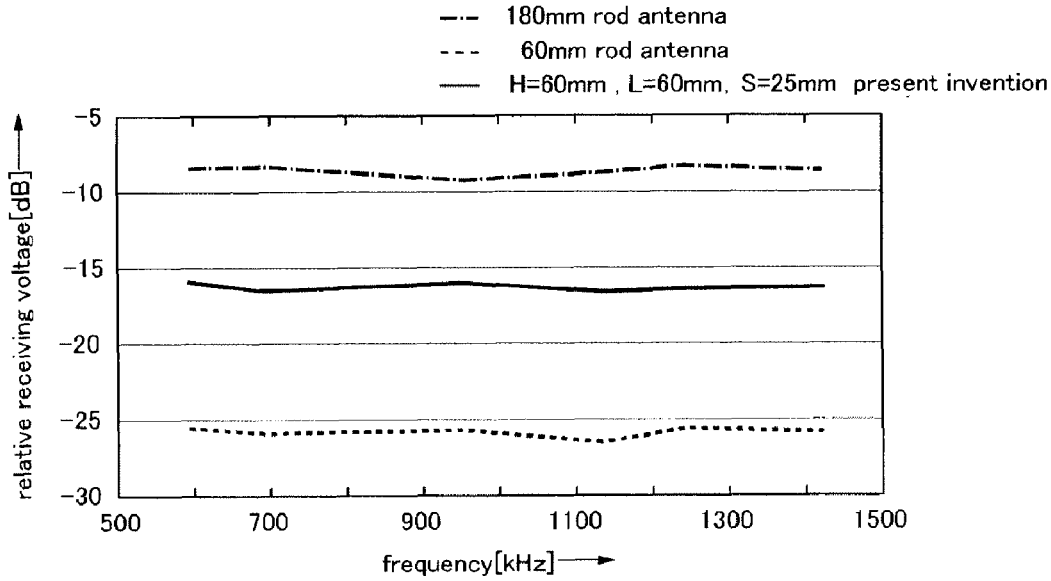
FIG. 17 is a graph showing a relative receiving voltage characteristic in an AM waveband of the antenna apparatus according to the first embodiment of the present invention together with a relative receiving voltage characteristic of a conventional antenna.

A relative received voltage characteristic in the AM waveband of the antenna apparatus 1 according to the first embodiment including the antenna unit constituted by the antenna pattern 31 and the antenna coil 32 formed on the antenna circuit board 30 shown in FIG. 11 and relative received voltage characteristics of a prior antenna are shown in FIG. 17. A relative received voltage on the ordinate in FIG. 17 is a relative received voltage [dB] obtained when a received voltage in the AM waveband excited by a metal rod having a length of 400 mm is set at 0 dB, and a relative received voltage characteristic indicated by an alternate long and short dash line is a relative received voltage characteristic obtained when the rod portion of the prior antenna apparatus 401 has a height of 180 mm, and a relative received voltage characteristic indicated by a broken line is a relative received voltage characteristic obtained when the rod portion of the prior antenna apparatus 401 shown in FIG. 41 has a height of 60 mm. A relative received voltage characteristic of the antenna apparatus 1 according to the first embodiment of the present invention indicated by a sold line in FIG. 17 is a relative received voltage characteristic in the AM waveband when both the height H and the length L of the antenna pattern 31 are set at about 60 mm and the interval S from the ground is set at about 25 mm. It is apparent that even though the antenna pattern 31 is low-profile to have a height H of 60 mm, a relative received voltage characteristic which is higher than the relative received voltage characteristic of the prior antenna apparatus 401 having the 60-mm rod portion by about 10 dB ore more can be obtained.

In this manner, in order to improve an electric characteristic in the antenna apparatus 1 according to the first embodiment of the present invention, the antenna pattern 31 is preferably arranged at a high position to be set apart from the ground as much as possible, and the antenna pattern 31 preferably occupies a large area.

Figure 18:
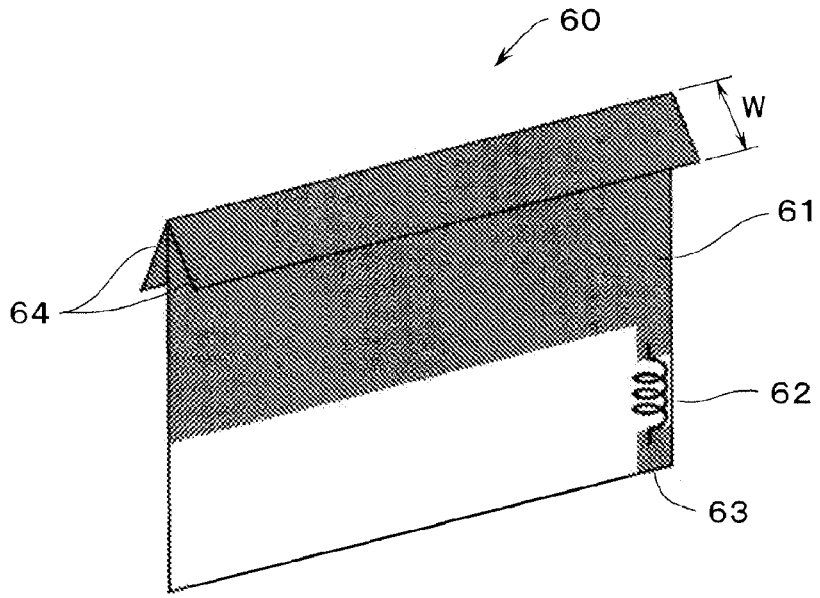
FIG. 18 is a diagram showing another configuration of the antenna circuit board of the antenna apparatus according to the first embodiment of the present invention.

Another configuration of the antenna circuit board is shown in FIG. 18. FIG. 18 shows a perspective view showing a configuration of an antenna circuit board 60 having the other configuration. The antenna circuit board 60 is a printed circuit board such as a glass epoxy circuit board having a preferable high-frequency characteristic. On the antenna circuit board 60, a plate-like antenna pattern 61 constituting an antenna and a pattern of a feeding point 63 are formed. An antenna coil 62 to resonate the antenna pattern 61 in an FM waveband is connected between the antenna pattern 61 and the feeding point 63. As a characteristic configuration of the antenna circuit board 60, an umbrella top 64 extending to both the ends at an upper end of the antenna pattern 61 is arranged. The top 64 has conductivity. The umbrella top 64 is arranged to make it possible to improve an electric characteristic of an antenna constituted by the antenna circuit board 60.

Figure 19:
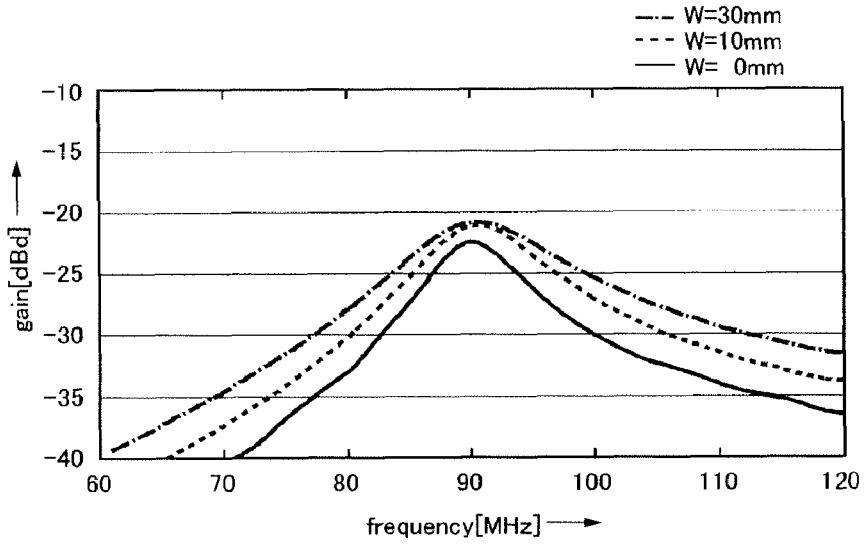
FIG. 19 is a graph showing a gain characteristic in an FM waveband obtained when the antenna circuit board having the other configuration is used in the antenna apparatus according to the first embodiment of the present invention.

Therefore, FIG. 19 shows a gain characteristic in the FM waveband of the antenna apparatus 1 having an antenna unit constituted by the antenna pattern 61 and the antenna coil 62 which are formed on the antenna circuit board 60 and have the top 64.

In FIG. 19, the ordinate indicates a gain [dBd] such that a gain of a dipole antenna having a half wavelength is set at 0 dB. A gain characteristic indicated by an alternate long and short dash line is a gain characteristic obtained when a projection width W of the top 64 is set at 30 mm, a gain characteristic indicated by a broken line is a gain characteristic obtained when the projection width W of the top 64 is set at about 10 mm, and a gain characteristic indicated by a solid line is a gain characteristic obtained when the projection width W of the top 64 is set at 0 mm, i.e., the top 64 is not arranged. As is apparent from FIG. 19, when the projection width W of the top 64 is set at about 10 mm, a gain which is larger than a gain obtained when the top 64 is not arranged by about 2 dB or more in the FM waveband is obtained. It is apparent that the gain further increases in a full range of the FM waveband when the projection width W is set at about 30 mm.

Figure 20:
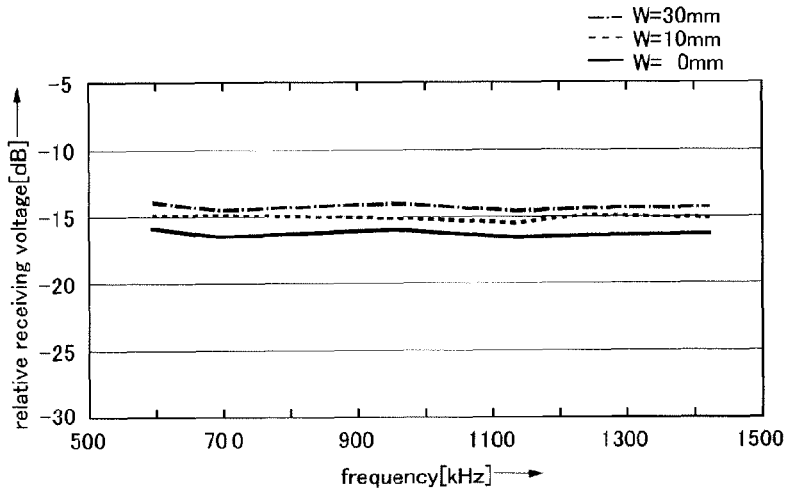
FIG. 20 is a graph showing a relative receiving voltage characteristic in an AM waveband when the antenna circuit board having other configuration is used in the antenna apparatus according to the first embodiment of the present invention.

FIG. 20 shows a relative received voltage characteristic in the AM waveband of the antenna apparatus 1 including the antenna unit constituted by the antenna pattern 61 and the antenna coil 62 which are formed on the antenna circuit board 60 and have the top 64.

In FIG. 20, a relative received voltage indicated by the ordinate is a relative received voltage [dB] obtained when a received voltage in the AM waveband excited by a metal rod having a length of 400 mm is set at 0 dB, and a relative received voltage characteristic indicated by an alternate long and short dash line is a relative received voltage characteristic obtained when the projection width W of the top 64 is set at 30 mm, a relative received voltage characteristic indicated by a broken line is a relative received voltage characteristic obtained when the projection width W of the top 64 is set at 10 mm, and a relative received voltage characteristic indicated by a solid line is a relative received voltage characteristic obtained when the projection width W of the top 64 is set at 0 mm, i.e., a relative received voltage characteristic obtained when the top 64 is not arranged. It is apparent from FIG. 20, when the projection width W of the top 64 is set at about 10 mm, a relative received voltage which is larger than a relative received voltage obtained when the top 64 is not arranged by about 1 to 2 dB is obtained. It is apparent that the relative received voltage increases in a full range of the AM waveband when the projection width W is set at about 30 mm. In this manner, the umbrella top 64 extending to both the sides at the upper end of the antenna pattern 61 is arranged to make it possible to increase a gain and a relative received voltage in the FM waveband and the AM waveband. The umbrella top 64 is arranged downward. However, the direction is not limited, and the top 64 may be arranged horizontally or upward.

Figure 21:
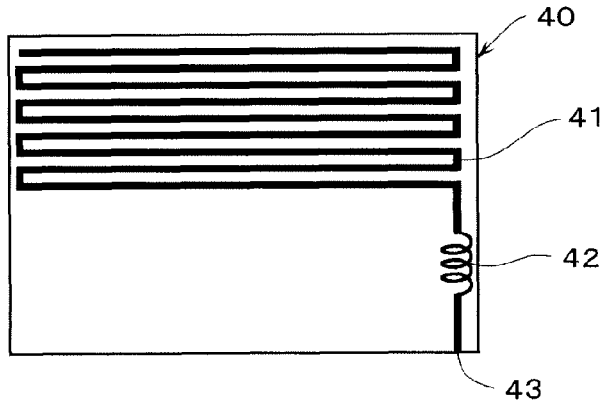
FIG. 21 is a diagram showing a configuration of a modification of an antenna pattern of the antenna apparatus according to the first embodiment of the present invention.

A configuration of a modification of an antenna pattern is shown in FIG. 21. An antenna circuit board 40 shown in FIG. 21 is a printed circuit board such as a glass epoxy circuit board having a good high-frequency characteristic. On the antenna circuit board 40, a meander-line-like antenna pattern 41 constituting an antenna and a pattern of a feeding point 43 are formed. An antenna coil 42 to resonate the antenna pattern 41 in an FM waveband is connected between the antenna pattern 41 and the feeding point 43.

Figure 22:
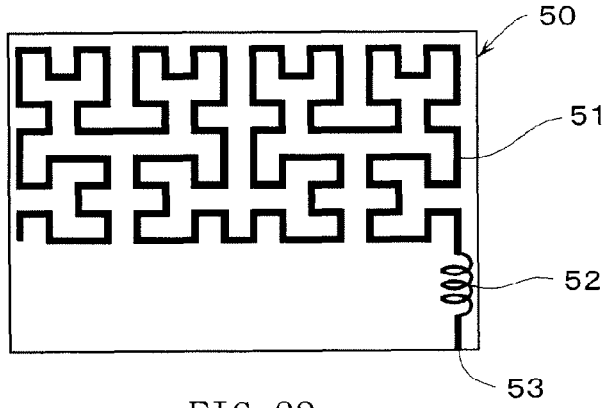
FIG. 22 is a diagram showing a configuration of another modification of an antenna pattern in the antenna apparatus according to the first embodiment of the present invention.

Furthermore, another modification of the antenna pattern is shown in FIG. 22. An antenna circuit board 50 shown in FIG. 22 is a printed circuit board such as a glass epoxy circuit board having a good high-frequency characteristic. On the antenna circuit board 50, a fractal-like circuit pattern 51 constituting an antenna and a pattern of a feeding point 53 are formed. An antenna coil 52 to resonate the antenna pattern 51 in an FM waveband is connected between the antenna pattern 51 and the feeding point 53.

Since both the antenna patterns having the shapes shown in FIGS. 21 and 22 are formed with small number of stages, the antenna patterns slightly generate conductor loss and do not considerably affect the electric characteristic in the AM waveband and the FM waveband.

Figure 23:
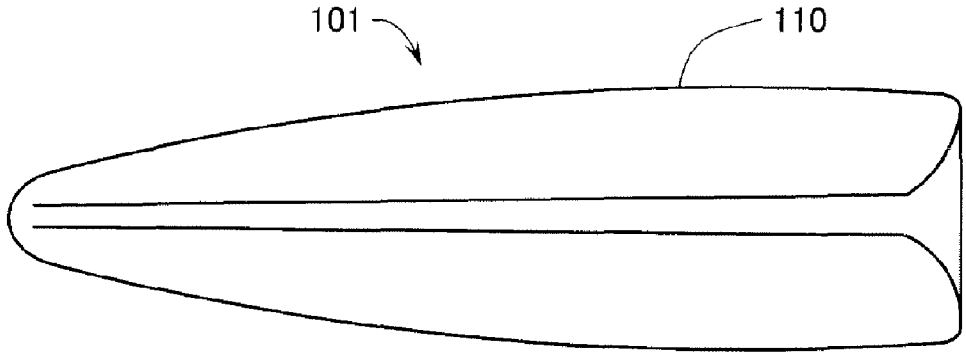
FIG. 23 is a plan view showing a configuration of an antenna apparatus according to a second embodiment of the present invention.
Figure 24:
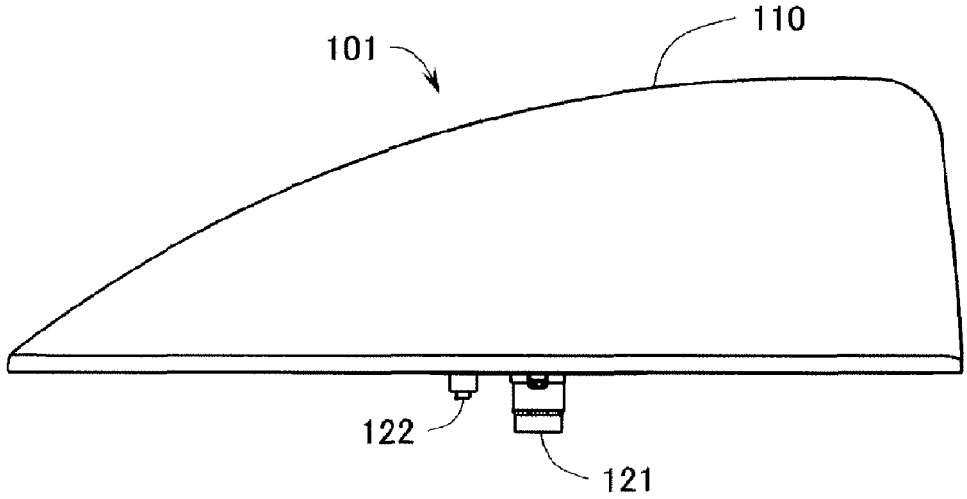
FIG. 24 is a side view showing the configuration of the antenna apparatus according to the second embodiment of the present invention.
Figure 25:
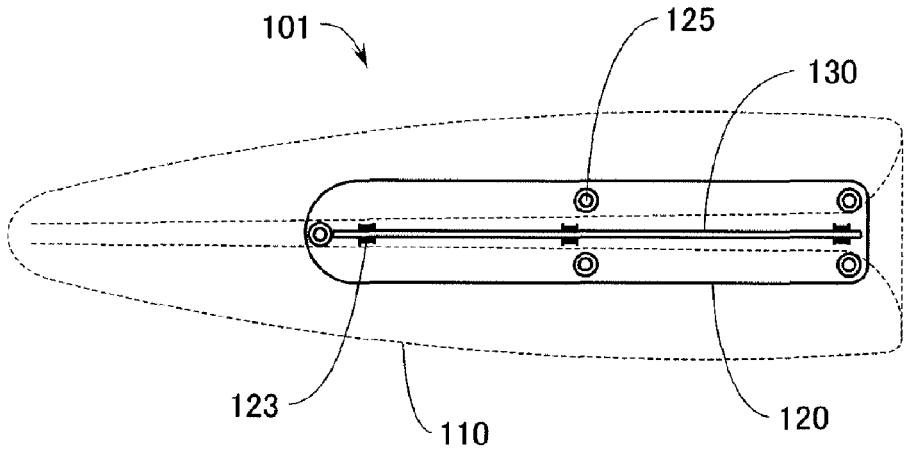
FIG. 25 is a plan view showing an internal configuration of the antenna apparatus according to the second embodiment of the present invention.
Figure 26:
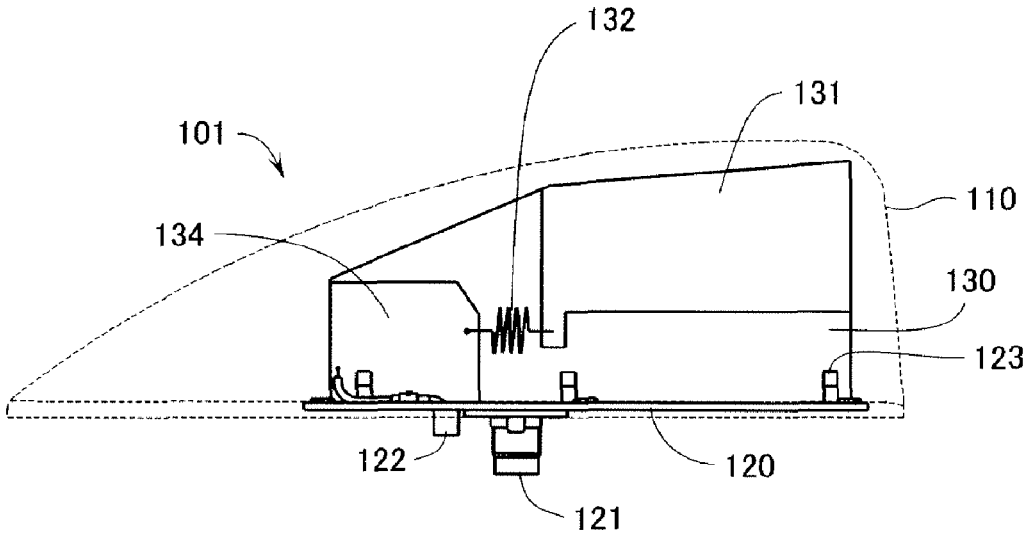
FIG. 26 is a side view showing the internal configuration of the antenna apparatus according to the second embodiment of the present invention.

A configuration of an antenna apparatus 101 for vehicle according to a second embodiment of the present invention is shown in FIGS. 23 to 26. FIG. 23 is a plan view showing the configuration of the antenna apparatus 101 according to the second embodiment of the present invention, FIG. 24 is a side view showing the configuration of the antenna apparatus 101 according to the second embodiment of the present invention, FIG. 25 is a plan view showing an internal configuration of the antenna apparatus 101 according to the second embodiment of the present invention, and FIG. 26 is a side view showing the internal configuration of the antenna apparatus 1 according to the second embodiment of the present invention.

As shown in these drawings, the antenna apparatus 101 according to the second embodiment of the present invention includes: an antenna case 110; an antenna base 120 housed in the antenna case 110; and one circuit board 130 attached to the antenna base 120 and housed in the antenna case 110. A height of the antenna case 110 is set at about 70 mm, and a longitudinal length is set at about 200 mm.

The antenna case 110 consists of a radiowave transmitting synthetic resin and has a streamlined outer shape which is tapered toward the distal end and has a smaller lateral width. A lower surface of the antenna case 110 has a shape matched with a shape of an attaching surface of the vehicle 2 to which the antenna case 110 is to be attached. In the antenna case 110, a space in which the antenna circuit board 130 can be uprightly housed is formed. A metal antenna base 120 is attached to the lower surface of the antenna case 110. On the antenna base 120, three circuit board fixing portions 123 which uprightly fix the circuit board 130 are arranged along an almost center line in the longitudinal direction. The circuit board 130 is fixed to the three circuit board fixing portions 123 such that the lower edge of the circuit board 130 is held between the circuit board fixing portions 123. For this reason, the metal antenna base 120 is attached to the lower surface of the antenna case 110 to make it possible to house the antenna circuit board 130 in the space of the antenna case 110. An upper edge of the uprightly fixed antenna circuit board 130 has a shape matched with a shape of the internal space of the antenna case 110. For this reason, the height of the antenna circuit board 130 can be made large as much as possible.

On the circuit board 130, for example, a plate-like antenna pattern 131 as shown in FIG. 26 is formed, and an amplifier unit 134 is formed on the circuit board 130. An antenna coil 132 to resonate the antenna pattern 131 in an FM waveband is inserted between the feeding point of the antenna pattern 131 and an input of the amplifier unit 134. In the amplifier unit 134, received signals of FM broadcast and AM broadcast which are received by the antenna unit constituted by the antenna pattern 131 and the antenna coil 132 are separated from each other and amplified and output by the amplifiers, respectively. An equivalent circuit diagram of the antenna apparatus 101 according to the second embodiment of the present invention is the same as the equivalent circuit diagram of the antenna apparatus 1 according to the first embodiment shown in FIG. 14.

From the lower surface of the antenna base 120, a bolt portion 121 to attach the antenna apparatus 101 to the vehicle 2 and a cable drawing port 122 from which a cable to guide a received signal from the antenna apparatus 101 into the vehicle 2 are formed to project. In this case, holes into which the bolt portion 121 and the cable drawing port 122 are formed in the roof of the vehicle 2. The antenna apparatus 101 is placed on the roof such that the bolt portion 121 and the cable drawing port 122 are inserted into the holes. A nut is fastened to the bolt portion 121 projecting into the vehicle 2 to make it possible to fix the antenna apparatus 101 on the roof of the vehicle 2. At this time, a received signal output from the amplifier unit 134 is guided into the vehicle 2 by a cable drawn from the cable drawing port 122 also serving as a positioning projection. A feeding cable for the amplifier unit 134 on the circuit board 130 housed in the antenna case 110 is guided from the vehicle 2 into the antenna case 110 through the cable drawing port 122.

In the antenna apparatus 101 according to the second embodiment of the present invention described above, the antenna pattern 131 and the amplifier unit 134 are arranged on one circuit board 130 to make it possible to omit fixing parts for the circuit board and to reduce the lateral width of the antenna case 110 to about 55 mm or less.

Figure 27:
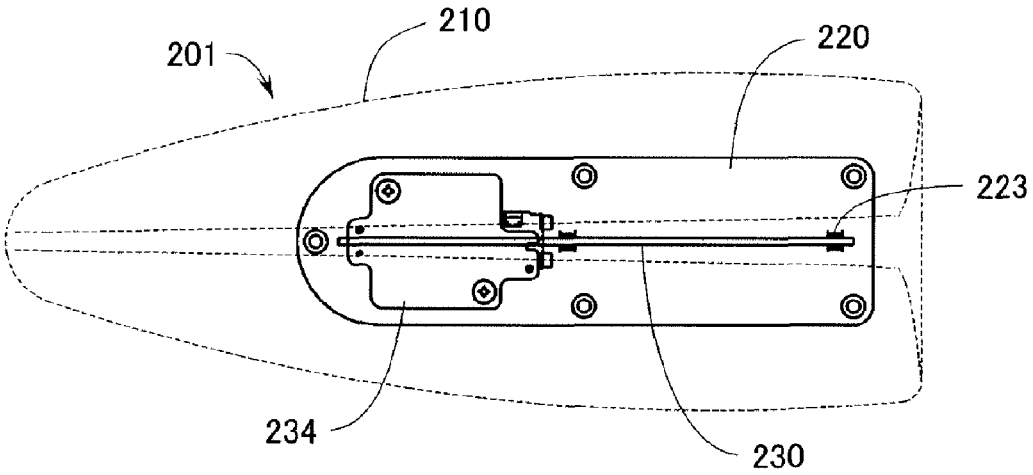
FIG. 27 is a plan view showing an internal configuration of the antenna apparatus according to a third embodiment of the present invention.
Figure 28:
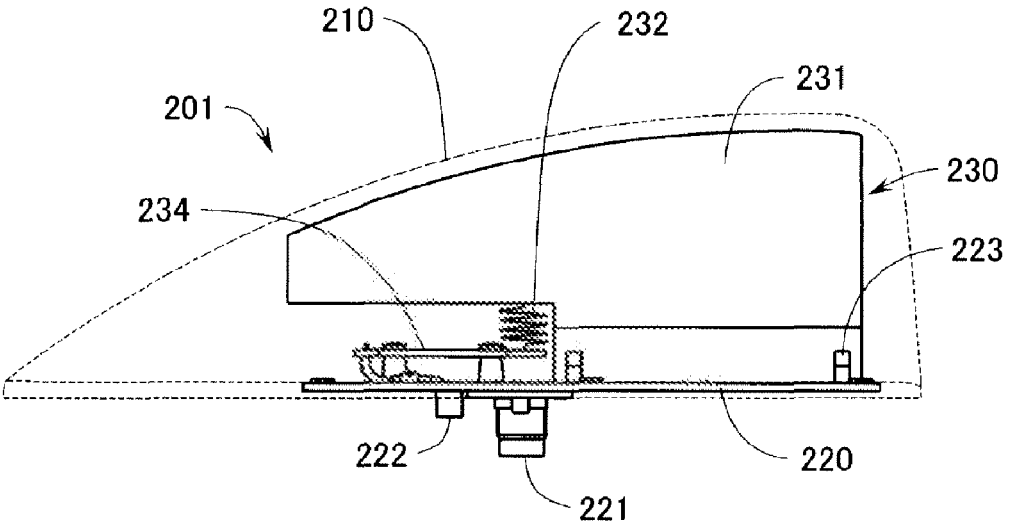
FIG. 28 is a side view showing the internal configuration of the antenna apparatus according to the third embodiment of the present invention.

A configuration of an antenna apparatus according to a third embodiment of the present invention is shown in FIGS. 27 and 28. FIG. 27 is a plan view showing an internal configuration of an antenna apparatus 201 according to the third embodiment of the present invention, and FIG. 28 is a side view showing the internal configuration of the antenna apparatus 201 according to the third embodiment of the present invention.

As shown in these drawings, the antenna apparatus 201 according to the third embodiment of the present invention includes: an antenna case 210; an antenna base 220 housed in the antenna case 210, an antenna circuit board 230 attached to the antenna base 220, and an amplifier circuit board 234 arranged immediately below the antenna circuit board 230. A height of the antenna case 210 is set at about 70 mm or less, and a longitudinal length and a lateral width are set at about 200 mm and about 75 mm, respectively.

The antenna case 210 consists of a radiowave transmitting synthetic resin and has a streamlined outer shape which is tapered toward the distal end. A lower surface of the antenna case 210 has a shape matched with a shape of an attaching surface of the vehicle 2 to which the antenna case 210 is to be attached. In the antenna case 210, a space in which the antenna circuit board 230 can be uprightly housed is formed, and a space in which the amplifier circuit board 234 can be horizontally housed is formed immediately below the antenna circuit board 230. A metal antenna base 220 is attached to the lower surface of the antenna case 210. On the antenna base 220, two circuit board fixing portions 223 which uprightly fix the circuit board 230 are arranged along an almost center line in the longitudinal direction. The antenna circuit board 230 is fixed to the two circuit board fixing portions 223 such that the lower edge of the circuit board 230 is held between the circuit board fixing portions 223. Almost half of the antenna circuit board 230 at the lower front thereof is notched, and an antenna pattern 231 is formed on the antenna circuit board 230 except for the lower portion thereof. The upper edge of the antenna circuit board 230 is formed to have almost the same shape as that of the inner upper surface of the antenna case 210, so that the antenna pattern 231 is arranged to occupy an area as largely as possible and to have a level as highly as possible.

In a space formed by partially notching the antenna circuit board 230, the amplifier circuit board 234 is arranged in a lateral direction, and the amplifier circuit board 234 is fixed to a pair of bosses formed on the upper surface of the antenna base 220 by screw fixation. An antenna coil 232 to resonate the antenna pattern 231 in an FM waveband is connected between the feeding point of the antenna pattern 231 and an input of the amplifier unit 234. In the amplifier unit 234, received signals of FM broadcast and AM broadcast which are received by the antenna unit constituted by the antenna pattern 231 and the antenna coil 232 are separated from each other and amplified and output by the amplifiers, respectively. An equivalent circuit diagram of the antenna apparatus 201 according to the third embodiment of the present invention is the same as the equivalent circuit diagram of the antenna apparatus 1 according to the first embodiment shown in FIG. 14.

From the lower surface of the antenna base 220, a bolt portion 221 to attach the antenna apparatus 201 to the vehicle 2 and a cable drawing port 222 from which a cable to guide a received signal from the antenna apparatus 201 into the vehicle 2 are formed to project. In this case, holes into which the bolt portion 221 and the cable drawing port 222 are formed in the roof of the vehicle 2. The antenna apparatus 201 is placed on the roof such that the bolt portion 221 and the cable drawing port 222 are inserted into the holes. A nut is fastened to the bolt portion 221 projecting into the vehicle 2 to make it possible to fix the antenna apparatus 201 on the roof of the vehicle 2. At this time, a received signal output from the amplifier unit 234 is guided into the vehicle 2 by a cable drawn from the cable drawing port 222 also serving as a positioning projection. A feeding cable for the amplifier circuit board 234 on the circuit board 230 housed in the antenna case 210 is guided from the vehicle 2 into the antenna case 210 through the cable drawing port 222.

In the antenna apparatus 201 according to the third embodiment of the present invention described above, the amplifier circuit board 234 is arranged immediately below the antenna circuit board 230 to make it possible to shorten the antenna apparatus 201 in the lateral direction. Therefore, an antenna apparatus according to a fourth embodiment of the present invention in which the antenna apparatus is shortened in the lateral direction as much as possible will be described below.

Figure 29:
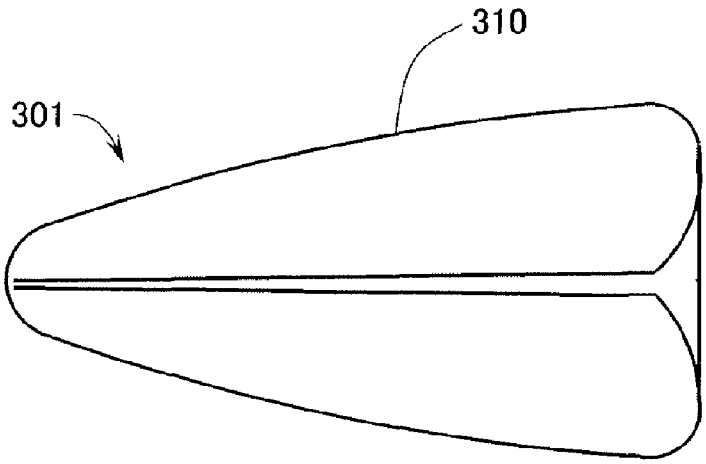
FIG. 29 is a plan view showing a configuration of an antenna apparatus according to a fourth embodiment of the present invention.
Figure 30:
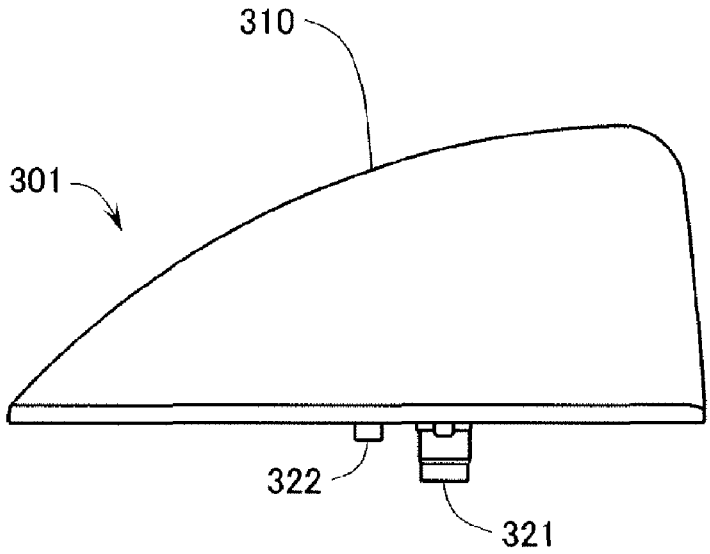
FIG. 30 is a side view showing the configuration of the antenna apparatus according to the fourth embodiment of the present invention.
Figure 31:
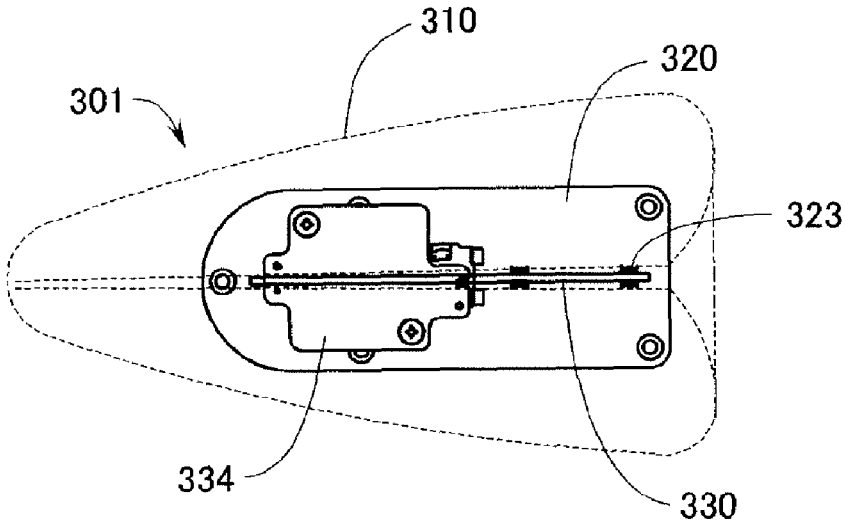
FIG. 31 is a plan view showing an internal configuration of the antenna apparatus according to the fourth embodiment of the present invention.
Figure 32:
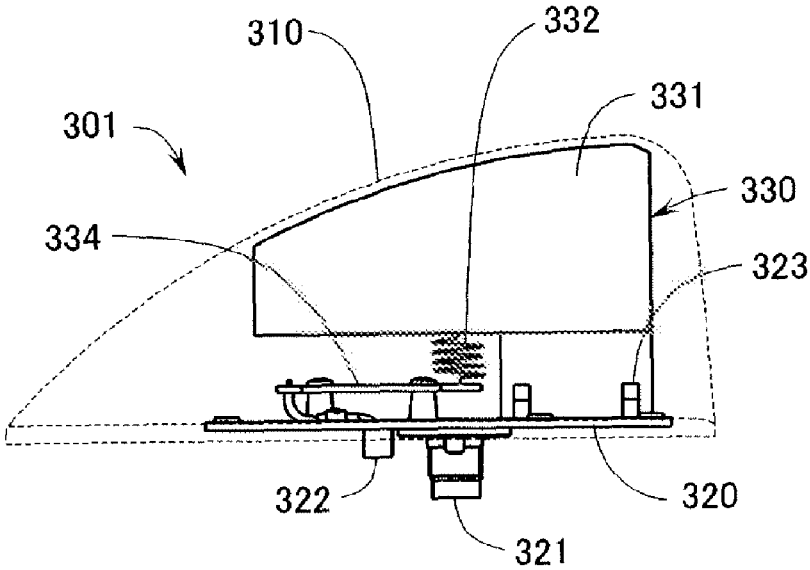
FIG. 32 is a side view showing the internal configuration of the antenna apparatus according to the fourth embodiment of the present invention.

A configuration of the antenna apparatus according to the fourth embodiment of the present invention will be described below with reference to FIGS. 29 and 32. FIG. 29 is a side view showing a configuration of an antenna apparatus 301 according to a fourth embodiment of the present invention, FIG. 30 is a plan view showing the configuration of the antenna apparatus 301 according to the fourth embodiment of the present invention, FIG. 31 is a plan view showing an internal configuration of the antenna apparatus 301 according to the fourth embodiment of the present invention, and FIG. 32 is a side view showing the internal configuration of the antenna apparatus 301 according to the fourth embodiment of the present invention.

As shown in these drawings, the antenna apparatus 301 according to the fourth embodiment of the present invention includes: an antenna case 310; an antenna base 320 housed in the antenna case 310, an antenna circuit board 330 attached to the antenna base 320, and an amplifier circuit board 334 arranged immediately below the antenna circuit board 330. A height of the antenna case 310 is set at about 70 mm or less, and a longitudinal length and a lateral width are set at about 160 mm and about 75 mm, respectively.

The antenna case 310 consists of a radiowave transmitting synthetic resin and has a streamlined outer shape which is tapered toward the distal end. A lower surface of the antenna case 310 has a shape matched with a shape of an attaching surface of the vehicle 2 to which the antenna case 310 is to be attached. In the antenna case 310, a space in which the antenna circuit board 330 can be uprightly housed is formed, and a space in which the amplifier circuit board 334 can be horizontally housed is formed immediately below the antenna circuit board 330. A metal antenna base 320 is attached to the lower surface of the antenna case 310. On the antenna base 320, two circuit board fixing portions 323 which uprightly fix the circuit board 330 are arranged along an almost center line in the longitudinal direction. The antenna circuit board 330 is fixed to the two circuit board fixing portions 323 such that the lower edge of the circuit board 330 is held between the circuit board fixing portions 323. Almost half of the antenna circuit board 330 at the lower front thereof is notched, and an antenna pattern 331 is formed on the antenna circuit board 330 except for the lower portion thereof. The antenna circuit board 330 is shortened as much as possible to minimize the antenna pattern 331 in size, an upper edge of the antenna circuit board 330 is formed to have almost the same shape as that of the inner upper surface of the antenna case 310, so that the antenna pattern 331 is arranged to occupy an area as largely as possible and to have a level as highly as possible.

In a space formed by partially notching the antenna circuit board 330, the amplifier circuit board 334 is arranged in a lateral direction, and the amplifier circuit board 334 is fixed to a pair of bosses formed on the upper surface of the antenna base 320 by screw fixation. An antenna coil 332 to resonate the antenna pattern 331 in an FM waveband is inserted between the feeding point of the antenna pattern 331 and an input of the amplifier unit 334. In the amplifier unit 334, received signals of FM broadcast and AM broadcast which are received by the antenna unit constituted by the antenna pattern 331 and the antenna coil 332 are separated from each other and amplified and output by the amplifiers, respectively. An equivalent circuit diagram of the antenna apparatus 301 according to the fourth embodiment of the present invention is the same as the equivalent circuit diagram of the antenna apparatus 1 according to the first embodiment shown in FIG. 14.

From the lower surface of the antenna base 320, a bolt portion 321 to attach the antenna apparatus 301 to the vehicle 2 and a cable drawing port 322 from which a cable to guide a received signal from the antenna apparatus 301 into the vehicle 2 are formed to project. In this case, holes into which the bolt portion 321 and the cable drawing port 322 are connected are formed in the roof of the vehicle 2. The antenna apparatus 301 is placed on the roof such that the bolt portion 321 and the cable drawing port 322 are inserted into the holes. A nut is fastened to the bolt portion 321 projecting into the vehicle 2 to make it possible to fix the antenna apparatus 301 on the roof of the vehicle 2. At this time, a received signal output from the amplifier unit 334 is guided into the vehicle 2 by a cable drawn from the cable drawing port 322 also serving as a positioning projection. A feeding cable for the amplifier circuit board 334 on the circuit board 330 housed in the antenna case 310 is guided from the vehicle 2 into the antenna case 310 through the cable drawing port 322.

In the antenna apparatus 301 according to the fourth embodiment of the present invention described above, the antenna pattern 331 is minimized in size to make it possible to shorten the antenna apparatus 301 in the lateral direction to about 160 mm.

As described above, the antenna apparatus 1 according to the first embodiment of the present invention to the antenna apparatus 301 according to the fourth embodiment can be used as sub-antennas for receiving FM broadcast. Therefore, a configuration in which the antenna apparatus 1 according to the first embodiment is used as a sub-antenna for receiving FM broadcast is shown in FIG. 33.

Figure 33:
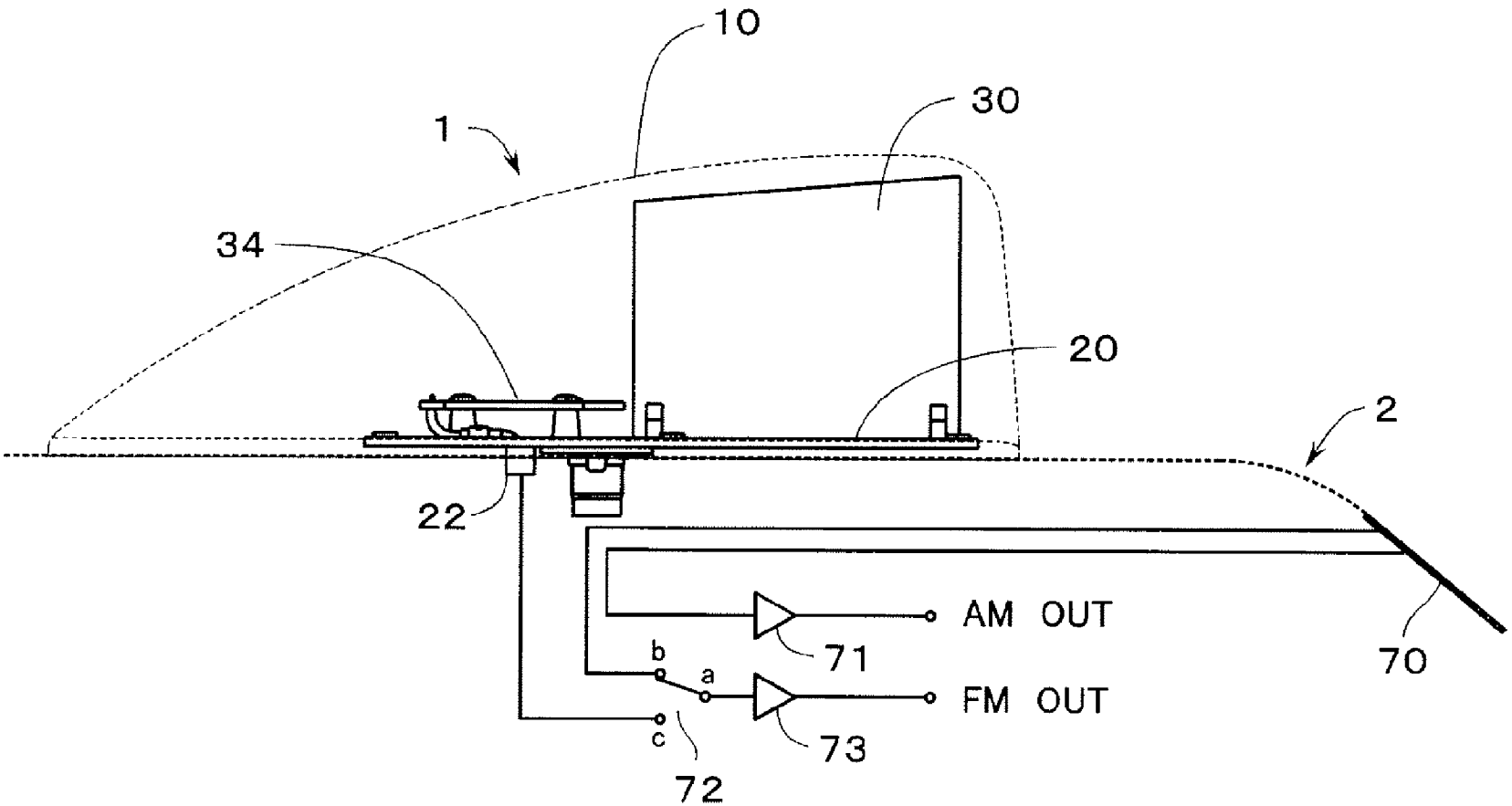
FIG. 33 is a diagram showing a configuration in which the antenna apparatus according to the embodiment of the present invention is used as a sub-antenna for receiving FM broadcast.

As shown in FIG. 33, an AM/FM glass antenna 70 serving as a main antenna which can receive AM broadcast and FM broadcast are arranged on a rear window of the vehicle 2. The antenna apparatus 1 is attached on the roof of the vehicle 2. Only a received signal of FM broadcast is output through a cable guided from the cable drawing port 22 in the antenna apparatus 1. The cable is connected to a fixed contact c of a switch (SW) 72. An AM broadcast received signal and an FM broadcast received signal are derived from the AM/FM glass antenna 70 through different cables, respectively. The cable for deriving the AM broadcast received signal is connected to an input of the AM amplifier 71, and the cable for deriving the FM broadcast received signal is connected to a fixed contact b of the SW 72. The AM signal amplified by an AM amplifier 71 is output from an AM output terminal (AM OUT) and supplied to a receiver arranged inside the vehicle 2.

Figure 34:
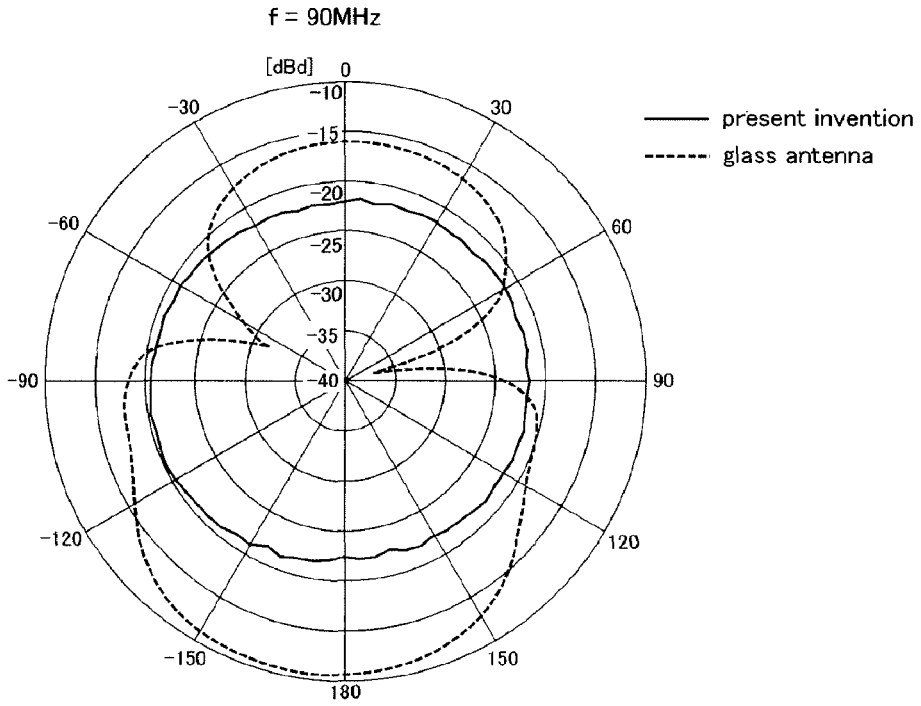
FIG. 34 is a diagram showing an in-horizontal-plane directional pattern obtained when frequencies f of an AM/FM glass antenna and the antenna apparatus in the configuration shown in FIG. 33 are set at 90 MHz.
Figure 35:
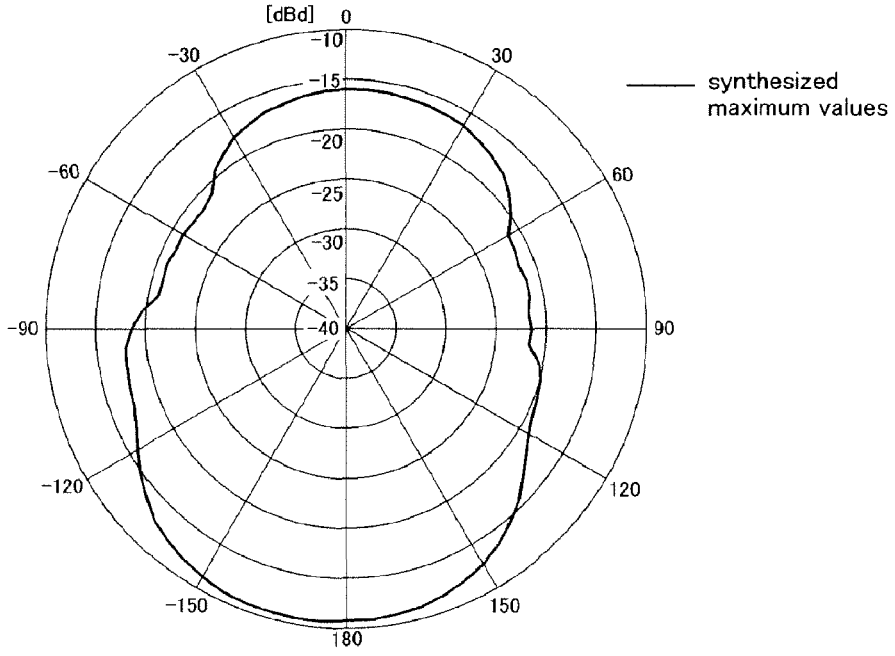
FIG. 35 is a diagram showing an in-horizontal-plane directional pattern obtained when the maximum values of the AM/FM glass antenna and the antenna apparatus in the configuration shown in FIG. 33 are synthesized.

An FM signal output from a movable contact a of the SW 72 and selected by the SW 72 is amplified by an FM amplifier 73, output from an FM output terminal (FM OUT), and supplied to a receiver arranged inside the vehicle 2. In the SW 72, an FM signal having a large receiving power of the signals in the AM/FM glass antenna 70 and the antenna apparatus 1 is preferably selected and output. In this case, the FM signal having the larger receiving power may be automatically selected and output. Furthermore, in place of the SW 72, the FM received signals in the AM/FM glass antenna 70 and the antenna apparatus 1 may be output such that the maximum values of the signals are synthesized with each other. In this case, in-horizontal-plane directional patterns obtained when frequencies f of the AM/FM glass antenna 70 and the antenna apparatus 1 are set at 90 MHz are shown in FIG. 34. Referring to FIG. 34, the in-horizontal-plane directional pattern of the antenna apparatus 1 is almost a nondirectional pattern. However, the in-horizontal-plane directional pattern of the AM/FM glass antenna 70 stuck on the rear window obtains the maximum gain toward the rear of the vehicle 2, and the gain is higher than the maximum gain of the antenna apparatus 1 by about 10 dB. An in-horizontal-plane directional pattern obtained when the maximum values of the FM received signals of the AM/FM glass antenna 70 and the antenna apparatus 1 are synthesized with each other is shown in FIG. 35. Referring to FIG. 35, the maximum gain of about −11 dBd is obtained toward the rear of the vehicle 2, and a gain of about −16 dBd is obtained toward the front of the vehicle 2.

In the antenna apparatus according to the present invention, FM broadcast can be received, and AM broadcast can also be received. However, the antenna apparatus can be operated as an antenna for other communication such as a mobile television service (TDTV) or a mobile telephone band (TEL). A configuration of the antenna circuit used in this case is shown in FIGS. 36 to 40.

Figure 36:
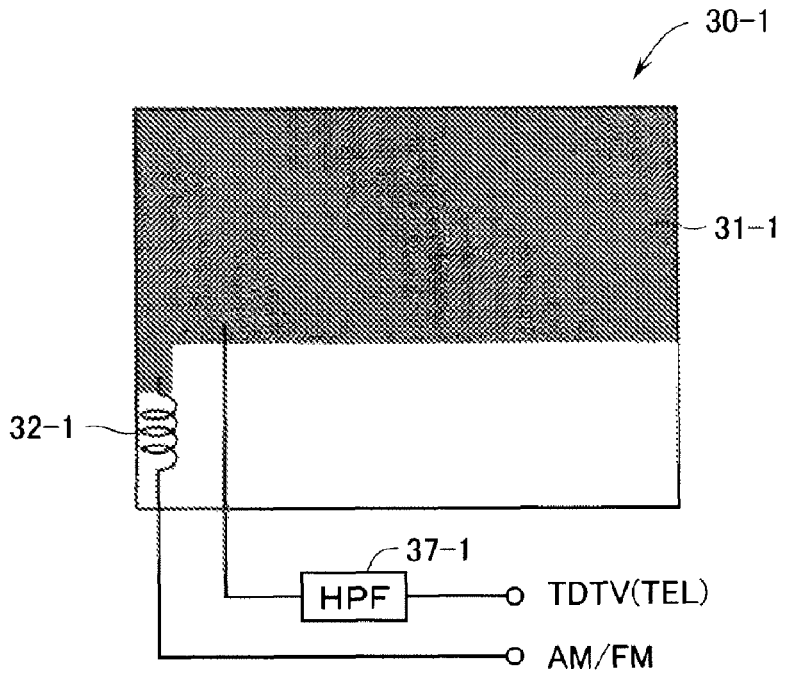
FIG. 36 is a diagram showing a configuration obtained when an antenna circuit board in the antenna apparatus according to the present invention is used as an antenna for AM/FM broadcast and an antenna for TDTV or TEL.

An antenna circuit board 30-1 shown in FIG. 36 is a configuration in which the antenna is used as an antenna for AM/FM broadcast and an antenna for TDTV or TEL. One plate-like antenna pattern 31-1 is formed on almost an upper half of the antenna circuit board 30-1. One terminal of an antenna coil 32-1 is connected to the antenna pattern 31-1, and the other terminal of the antenna coil 32-1 is connected to an AM/FM output terminal from which an AM/FM received signal is output. One terminal of a high-pass filter (HPF) 37-1 which passes a signal in only a frequency band of the TDTV (TEL) signal is connected to the antenna pattern 31-1, and the other terminal is connected to a TDTV (TEL) terminal for the TDTV (TEL) signal. The AM/FM output terminal is connected to an AM/FM receiver, and the TDTV (TEL) terminal is connected to a TDTV receiver (TEL). In this case, the antenna pattern 31-1 preferably has a size to resonate in a frequency band of TDTV (TEL).

Figure 37:
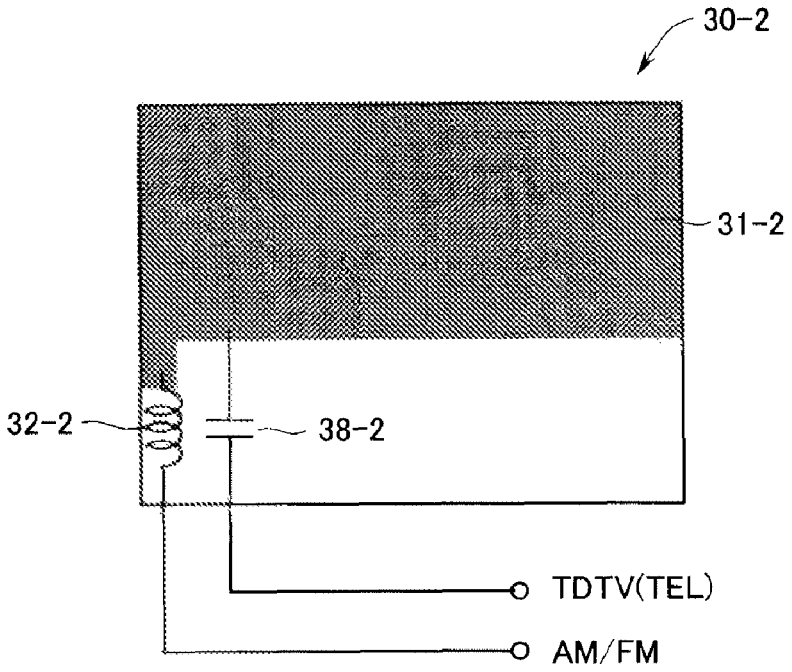
FIG. 37 is a diagram showing another configuration obtained when an antenna circuit board in the antenna apparatus according to the present invention is used as an antenna for AM/FM broadcast and an antenna for TDTV or TEL.

An antenna circuit board 30-2 shown in FIG. 37 is another configuration in which the antenna is used as an antenna for AM/FM broadcast and an antenna for TDTV or TEL. One plate-like antenna pattern 31-2 is formed on almost an upper half of the antenna circuit board 30-2. One terminal of an antenna coil 32-2 is connected to the antenna pattern 31-2, and the other terminal of the antenna coil 32-2 is connected to an AM/FM output terminal from which an AM/FM received signal is output. One terminal of a capacitor 38-2 which blocks a signal in a low-frequency band serving as an AM/FM signal is connected to the antenna pattern 31-2, and the other terminal of the capacitor 38-2 is connected to a TDTV (TEL) terminal for the TDTV (TEL) signal. The AM/FM output terminal is connected to an AM/FM receiver, and the TDTV (TEL) terminal is connected to a TDTV receiver (TEL). In this case, the antenna pattern 31-2 preferably has a size to resonate in a frequency band of TDTV (TEL).

Figure 38:
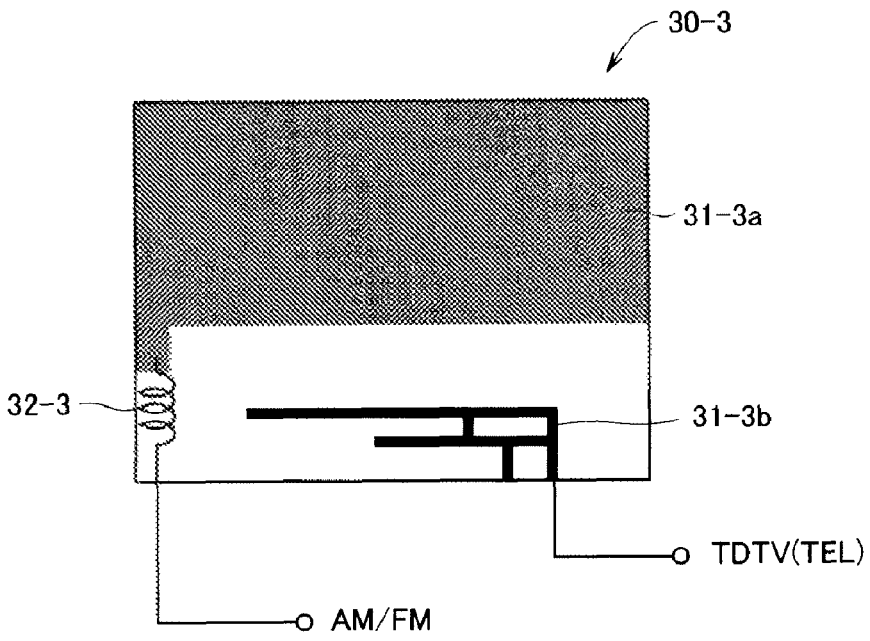
FIG. 38 is a diagram showing still another configuration obtained when an antenna circuit board in the antenna apparatus according to the present invention is used as an antenna for AM/FM broadcast and an antenna for TDTV or TEL.

An antenna circuit board 30-3 shown in FIG. 38 is still another configuration in which the antenna is used as an antenna for AM/FM broadcast and an antenna for TDTV or TEL. One plate-like antenna pattern 31-3*a* is formed on almost an upper half of the antenna circuit board 30-3, and a linear second antenna pattern 31-3*b* which resonates in a frequency band of TDTV (TEL) is formed on almost a lower half of the antenna circuit board 30-3. One terminal of an antenna coil 32-3 is connected to the antenna pattern 31-1*a*, and the other terminal of the antenna coil 32-3 is connected to an AM/FM output terminal from which an AM/FM received signal is output. A feeding point of the second antenna pattern 31-3*b* is connected to a TDTV (TEL) terminal for a TDTV (TEL) signal. The AM/FM output terminal is connected to an AM/FM receiver, and the TDTV (TEL) terminal is connected to a TDTV receiver (TEL).

Figure 39:
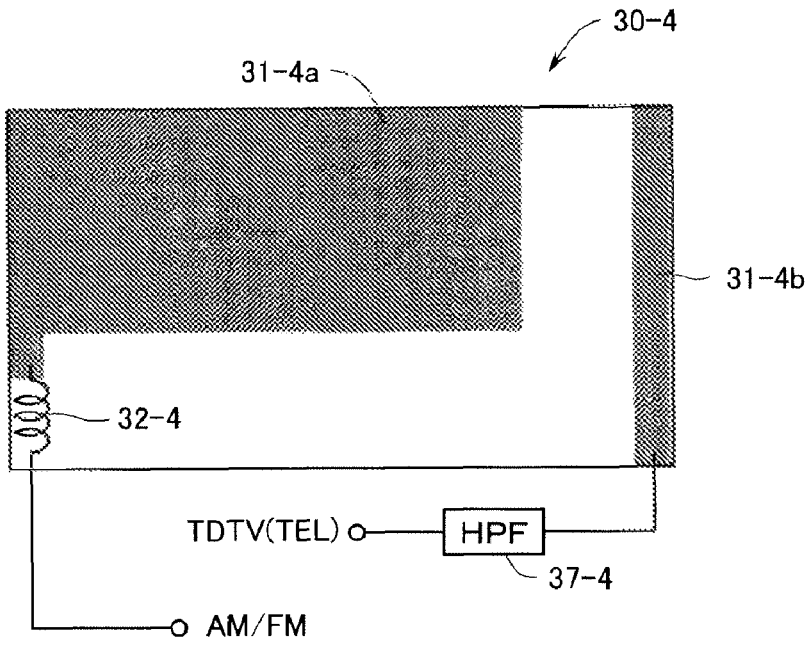
FIG. 39 is a diagram showing still another configuration obtained when an antenna circuit board in the antenna apparatus according to the present invention is used as an antenna for AM/FM broadcast and an antenna for TDTV or TEL.

An antenna circuit board 30-4 shown in FIG. 39 is still another configuration in which the antenna is used as an antenna for AM/FM broadcast and an antenna for TDTV or TEL. The antenna circuit board 30-4 has a horizontally long shape. One plate-like first antenna pattern 31-4*a* is formed on almost an upper half of the antenna circuit board 30-4 except for a right side of the drawing, and a linear second antenna pattern 31-4*b* which resonates in a frequency band of TDTV (TEL) is formed on the right side of the drawing in a longitudinal direction. One terminal of an antenna coil 32-4 is connected to the first antenna pattern 31-4*a*, and the other terminal of the antenna coil 32-4 is connected to an AM/FM output terminal from which an AM/FM received signal is output. A feeding point of the second antenna pattern 31-4*b* is connected to a TDTV (TEL) terminal for a TDTV (TEL) signal through an HPF 37-4 which passes a signal in a frequency band of the TDTV (TEL) signal. The AM/FM output terminal is connected to an AM/FM receiver, and the TDTV (TEL) terminal is connected to a TDTV receiver (TEL).

Figure 40:
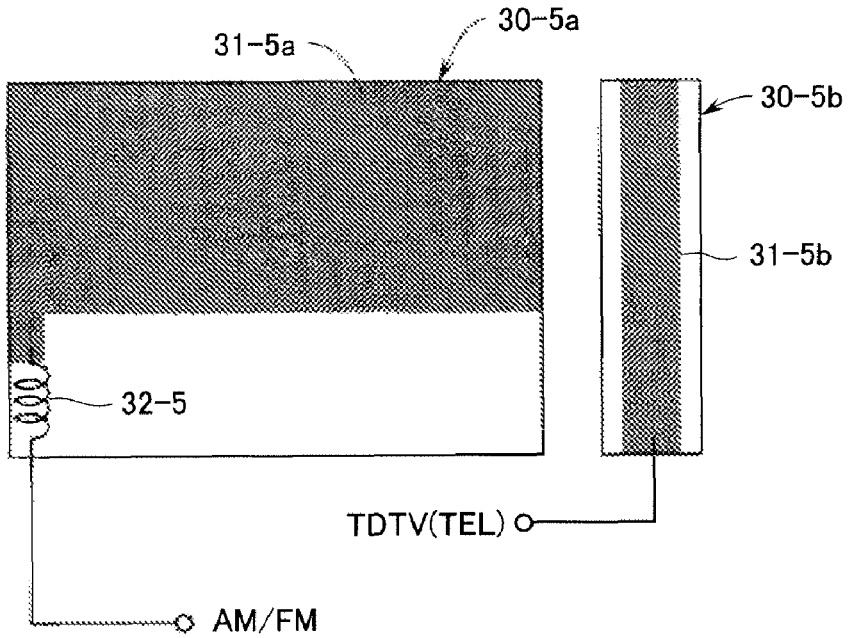
FIG. 40 is a diagram showing still another configuration obtained when an antenna circuit board in the antenna apparatus according to the present invention is used as an antenna for AM/FM broadcast and an antenna for TDTV or TEL.

An antenna circuit board shown in FIG. 40 is constituted by two circuit boards, i.e., a first antenna circuit board 30-5*a* and a second antenna circuit board 30-5*b*, and is still another configuration in which the antenna is used as an antenna for AM/FM broadcast or an antenna for TDTV or TEL. One plate-like first antenna pattern 31-5*a* is formed on almost an upper half of the first antenna circuit board 30-5, and a linear second antenna pattern 31-5*b* which resonates in a frequency band of TDTV (TEL) is formed in a longitudinal direction of the second antenna circuit board 30-5*b* which is long and narrow in the longitudinal direction. One terminal of an antenna coil 32-5 is connected to the first antenna pattern 31-5*a*, and the other terminal of the antenna coil 32-5 is connected to an AM/FM output terminal from which an AM/FM received signal is output. A feeding point of the second antenna pattern 31-5*b* is connected to a TDTV (TEL) terminal for a TDTV (TEL) signal. The AM/FM output terminal is connected to an AM/FM receiver, and the TDTV (TEL) terminal is connected to a TDTV receiver (TEL).

All the antenna circuit boards in the configurations shown in FIGS. 36 to 40 are printed circuit boards such as glass epoxy circuit boards having a good high-frequency characteristic and housed in antenna cases, respectively.

Figure 42:
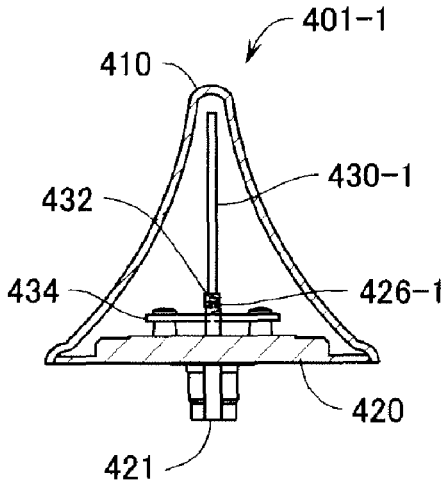
FIG. 42 is a front view showing a section obtained by cutting the configuration of the antenna apparatus according to the fifth embodiment of the present invention.

A configuration of an antenna apparatus according to a fifth embodiment is shown in FIGS. 41 and 42. FIG. 41 is a side view showing a configuration of an antenna apparatus 401-1 according to the fifth embodiment of the present invention, and FIG. 42 is a front view showing a section obtained by cutting the configuration of the antenna apparatus 401-1 according to the fifth embodiment of the present invention along a b1-b1 line.

As shown in these drawings, the antenna apparatus 401-1 according to the fifth embodiment of the present invention includes an antenna case 410, an antenna base 420 housed in the antenna case 410, a planar antenna 430-1 which is fixed to the antenna base 420 through a plurality of insulating spacers 426-1, and an amplifier circuit board 434. A length of the antenna case 410 in a longitudinal direction is set at about 200 mm. The antenna case 410 has a height of about 70 mm or less.

The antenna case 410 is composed of a synthetic resin having radio-wave permeability, and has a streamlined outer shape which is tapered off. A lower surface of the antenna case 410 has a shape which is matched with a shape of a fixing surface of the vehicle 2 to which the lower surface is to be fixed. In the antenna case 410, a space in which the antenna 430-1 can be upright housed and a space in which the amplifier circuit board 434 can be horizontally housed are formed. The antenna base 420 made of a metal is fixed to the lower surface of the antenna case 410. The two insulating spacers 426-1 are upright formed on the antenna base 420, and a planar antenna 430-1 is upright fixed to the distal end of the insulating spacer 426-1. The antenna 430-1 is formed by processing a metal plate or depositing or sticking a metal material to an insulating plate. Since the amplifier circuit board 434 is fixed beside the antenna 430-1, the metal antenna base 420 is fixed to the lower surface of the antenna case 410 to make it possible to house the antenna 430-1 and the amplifier circuit board 434 in the space of the antenna case 410. An upper edge of the antenna 430-1 which is upright fixed is formed to have a shape matched with the shape of the internal space of the antenna case 410, and the antenna 430-1 is preferably formed as highly as possible.

An amplifier unit is arranged on the amplifier circuit board 434, and an antenna coil 432 to resonate the antenna 430-1 in an FM band is inserted between a feeding point of the antenna 430-1 and an input of the amplifier unit. In the amplifier unit, received signals for an FM broadcast and an AM broadcast received by the antenna unit including the antenna 430-1 and the antenna coil 432 are separated from each other and amplified by amplifiers and output. An equivalent circuit diagram of the antenna apparatus 401-1 according to the fifth embodiment of the present invention is the same as the equivalent circuit diagram of the antenna apparatus 1 according to the first embodiment shown in FIG. 14.

From the lower surface of the antenna base 420, a bolt portion 421 to fix the antenna apparatus 401-1 to the vehicle 2 and a cable drawing port 422 which draws a cable to lead a received signal from the antenna apparatus 401-1 into the vehicle 2 are convexly formed. In this case, holes through which the bolt portion 421 and the cable drawing port 422 are inserted are formed in a roof of the vehicle 2. The antenna apparatus 401-1 is mounted on the roof such that the bolt portion 421 and the cable drawing port 422 are inserted into these holes. A nut is fastened to the bolt portion 421 projecting in the vehicle 2 to make it possible to fix the antenna apparatus 401-1 to the roof of the vehicle 2. At this time, the cable drawn from the cable drawing port 422 functioning as a projection for positioning is led into the vehicle 2. A feeding cable to the amplifier circuit board 434 housed in the antenna case 410 is led from the inside of the vehicle 2 into the antenna case 410 through the cable drawing port 422.

Figure 43:
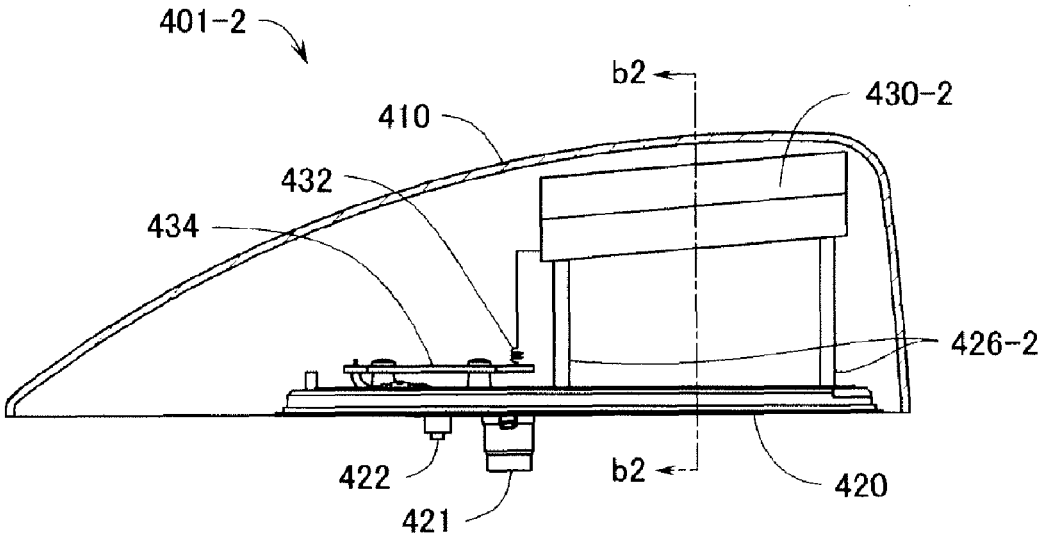
FIG. 43 is a side view showing the configuration of the antenna apparatus according to the sixth embodiment of the present invention.
Figure 44:
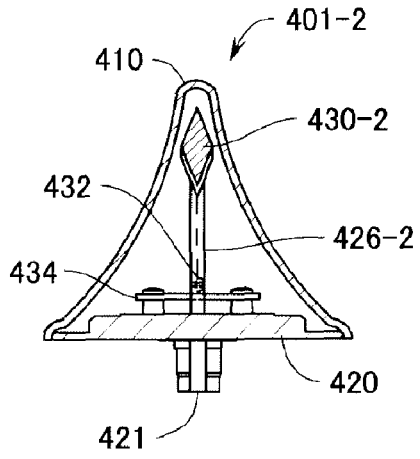
FIG. 44 is a front view showing a section obtained by cutting the configuration of the antenna apparatus according to the sixth embodiment of the present invention.

A configuration of an antenna apparatus according to a sixth embodiment is shown in FIGS. 43 and 44. FIG. 43 is a side view showing a configuration of an antenna apparatus 401-2 according to the sixth embodiment of the present invention, and FIG. 44 is a front view showing a section obtained by cutting the configuration of the antenna apparatus 401-2 according to the sixth embodiment of the present invention along a b2-b2 line.

As shown in these drawings, the antenna apparatus 401-2 according to the sixth embodiment of the present invention includes an antenna case 410, an antenna base 420 housed in the antenna case 410, a bar-like antenna 430-2 which is fixed to the antenna base 420 through a plurality of insulating spacers 426-2 and has a rhomboid-shaped section, and an amplifier circuit board 434. A length of the antenna case 410 in a longitudinal direction is set at about 200 mm. The antenna case 410 has a height of about 70 mm or less.

The configurations of the antenna case 410 and the antenna base 420 are the same as those in the fifth embodiment, and a description thereof will be omitted. However, the two insulating spacers 426-2 are upright formed on the antenna base 420, and the bar-like antenna 430-2 having a rhomboid-shaped section is upright fixed to the distal end of the insulating spacer 426-2. The antenna 430-2 is formed by processing a metal bar or depositing or sticking a metal material to an entire surface of an insulating bar having a rhomboid-shaped section. Since the antenna 430-2 and the amplifier circuit board 434 are fixed to the antenna base 420, the metal antenna base 420 is fixed to the lower surface of the antenna case 410 to make it possible to house the antenna 430-2 and the amplifier circuit board 434 in the space of the antenna case 410.

The configuration of the amplifier circuit board 434 is also the same as that of the fifth embodiment, and a description thereof will be omitted. However, an antenna coil 432 to resonate the antenna 430-2 in an FM band is inserted between a feeding point of the antenna 430-2 and an input of the amplifier unit arranged in the amplifier unit 434. In the amplifier unit, received signals for an FM broadcast and an AM broadcast received by the antenna unit including the antenna 430-2 and the antenna coil 432 are separated from each other and amplified by amplifiers and output. An equivalent circuit diagram of the antenna apparatus 401-2 according to the sixth embodiment of the present invention is the same as the equivalent circuit diagram of the antenna apparatus 1 according to the first embodiment shown in FIG. 14.

Figure 45:
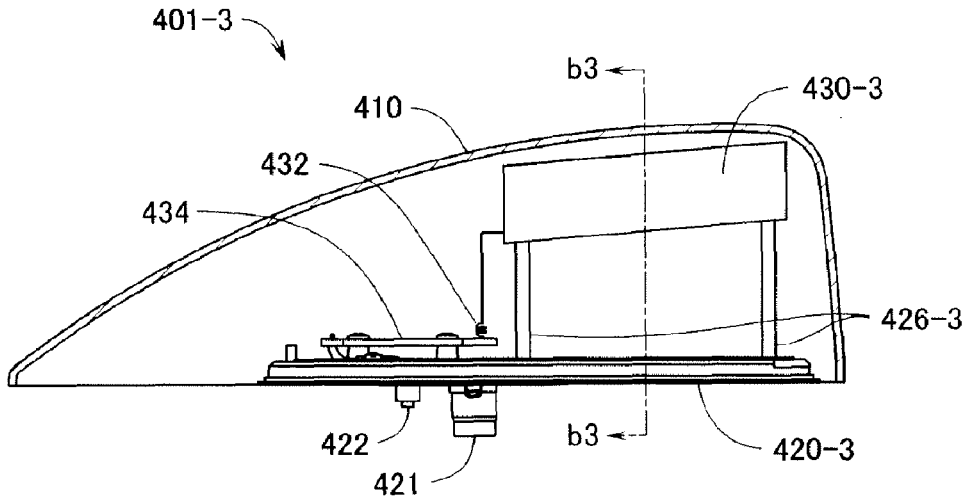
FIG. 45 is a side view showing the configuration of the antenna apparatus according to the seventh embodiment of the present invention.
Figure 46:
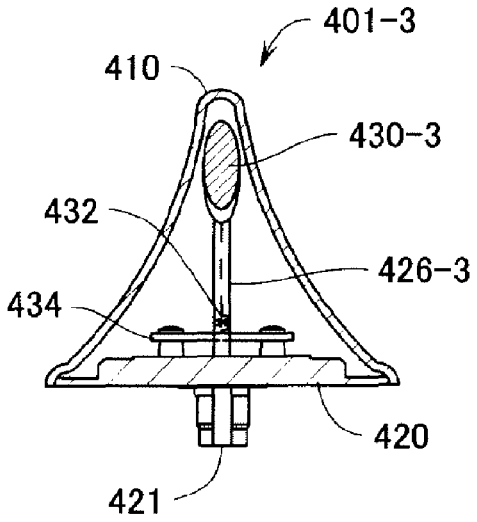
FIG. 46 is a front view showing a section obtained by cutting the configuration of the antenna apparatus according to the seventh embodiment of the present invention.

A configuration of an antenna apparatus according to a seventh embodiment is shown in FIGS. 45 and 46. FIG. 45 is a sectional view showing a configuration of an antenna apparatus 401-3 according to the seventh embodiment of the present invention, and FIG. 46 is a front view showing a section obtained by cutting the configuration of the antenna apparatus 401-3 according to the seventh embodiment of the present invention along a b3-b3 line.

As shown in these drawings, the antenna apparatus 401-3 according to the seventh embodiment of the present invention includes an antenna case 410, an antenna base 420 housed in the antenna case 410, a bar-like antenna 430-3 which is fixed to the antenna base 420 through a plurality of insulating spacers 426-3 and has an elliptical section, and an amplifier circuit board 434. A length of the antenna case 410 in a longitudinal direction is set at about 200 mm. The antenna case 410 has a height of about 70 mm or less.

The configurations of the antenna case 410 and the antenna base 420 are the same as those in the fifth embodiment, and a description thereof will be omitted. However, the two insulating spacers 426-3 are upright formed on the antenna base 420, and the bar-like antenna 430-3 having an elliptical section is upright fixed to the distal end of the insulating spacer 426-3. The antenna 430-3 is formed by processing a metal bar or depositing or sticking a metal material to an entire surface of an insulating bar having an elliptical section. Since the antenna 430-3 and the amplifier circuit board 434 are fixed to the antenna base 420, the metal antenna base 420 is fixed to the lower surface of the antenna case 410 to make it possible to house the antenna 430-3 and the amplifier circuit board 434 in the antenna case 410.

The configuration of the amplifier circuit board 434 is also the same as that of the fifth embodiment, and a description thereof will be omitted. However, an antenna coil 432 to resonate the antenna 430-3 in an FM band is inserted between a feeding point of the antenna 430-3 and an input of an amplifier unit arranged on the amplifier circuit board 434. In the amplifier unit, received signals for an FM broadcast and an AM broadcast received by the antenna unit including the antenna 430-3 and the antenna coil 432 are separated from each other and amplified by amplifiers and output. An equivalent circuit diagram of the antenna apparatus 401-3 according to the seventh embodiment of the present invention is the same as the equivalent circuit diagram of the antenna apparatus 1 according to the first embodiment shown in FIG. 14.

Figure 47:
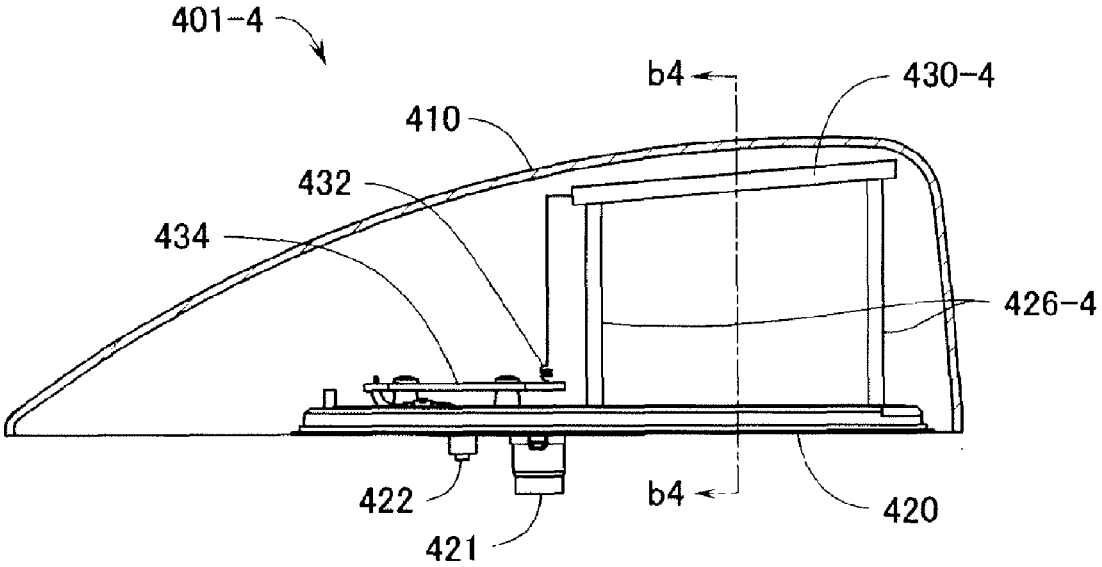
FIG. 47 is a side view showing the configuration of the antenna apparatus according to the eighth embodiment of the present invention.
Figure 48:
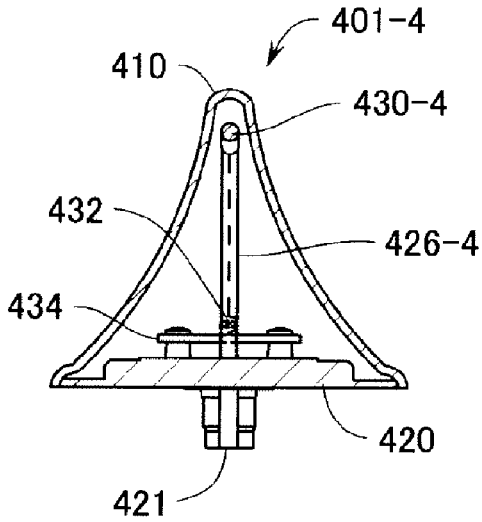
FIG. 48 is a front view showing a section obtained by cutting the configuration of the antenna apparatus according to the eighth embodiment of the present invention.

A configuration of an antenna apparatus according to an eighth embodiment is shown in FIGS. 47 and 48. FIG. 47 is a sectional view showing a configuration of an antenna apparatus 401-4 according to the eighth embodiment of the present invention, and FIG. 48 is a front view showing a section obtained by cutting the configuration of the antenna apparatus 401-4 according to the eighth embodiment of the present invention along a b4-b4 line.

As shown in these drawings, the antenna apparatus 401-4 according to the eighth embodiment of the present invention includes an antenna case 410, an antenna base 420 housed in the antenna case 410, a bar-like antenna 430-4 which is fixed to the antenna base 420 through a plurality of insulating spacers 426-4 and has a circular section, and an amplifier circuit board 434. A length of the antenna case 410 in a longitudinal direction is set at about 200 mm. The antenna case 410 has a height of about 70 mm or less.

The configurations of the antenna case 410 and the antenna base 420 are the same as those in the fifth embodiment, and a description thereof will be omitted. However, the two insulating spacers 426-4 are upright formed on the antenna base 420, and the bar-like antenna 430-4 having a circular section is upright fixed to the distal end of the insulating spacer 426-4. The antenna 430-4 is formed by processing a metal round bar or depositing or sticking a metal material to an entire surface of an insulating round bar having a circular section. Since the antenna 430-4 and the amplifier circuit board 434 are fixed to the antenna base 420, the metal antenna base 420 is fixed to the lower surface of the antenna case 410 to make it possible to house the antenna 430-4 and the amplifier circuit board 434 in the space of the antenna case 410.

The configuration of the amplifier circuit board 434 is also the same as that of the fifth embodiment, and a description thereof will be omitted. However, an antenna coil 432 to resonate the antenna 430-4 in an FM band is inserted between a feeding point of the antenna 430-4 and an input of an amplifier unit arranged on the amplifier circuit board 434. In the amplifier unit, received signals for an FM broadcast and an AM broadcast received by the antenna unit including the antenna 430-4 and the antenna coil 432 are separated from each other and amplified by amplifiers and output. An equivalent circuit diagram of the antenna apparatus 401-4 according to the eighth embodiment of the present invention is the same as the equivalent circuit diagram of the antenna apparatus 1 according to the first embodiment shown in FIG. 14.

Figure 49:
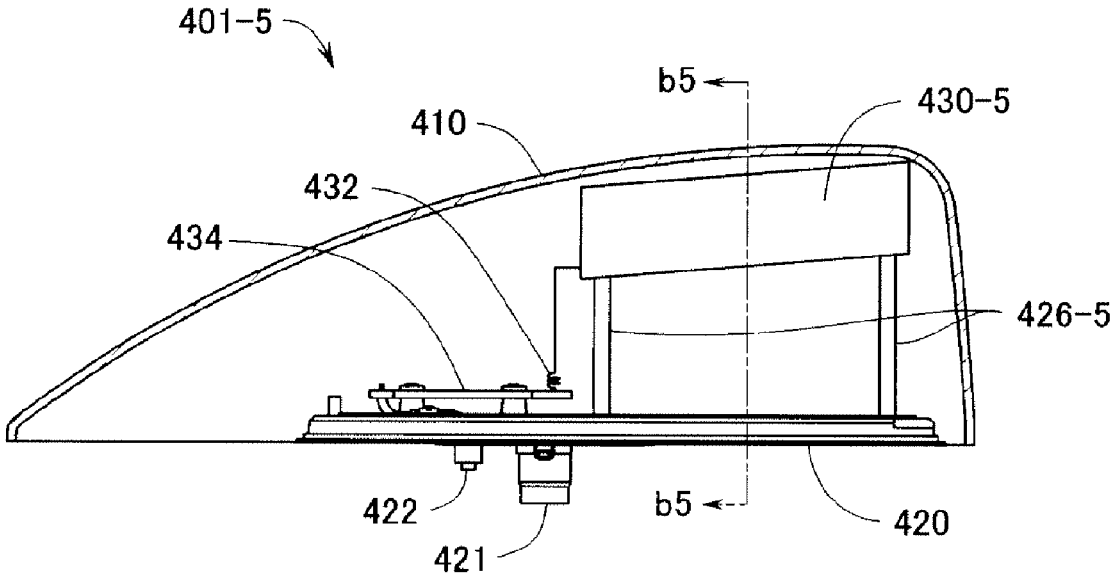
FIG. 49 is a side view showing the configuration of the antenna apparatus according to the ninth embodiment of the present invention.
Figure 50:
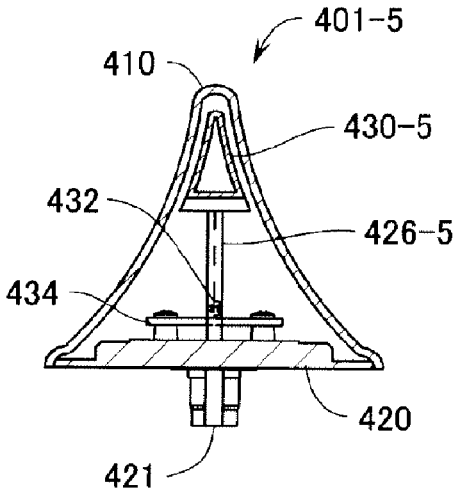
FIG. 50 is a front view showing a section obtained by cutting the configuration of the antenna apparatus according to the ninth embodiment of the present invention.

A configuration of an antenna apparatus according to a ninth embodiment is shown in FIGS. 49 and 50. FIG. 49 is a sectional view showing a configuration of an antenna apparatus 401-5 according to the ninth embodiment of the present invention, and FIG. 50 is a front view showing a section obtained by cutting the configuration of the antenna apparatus 401-5 according to the ninth embodiment of the present invention along a b5-b5 line.

As shown in these drawings, the antenna apparatus 401-5 according to the ninth embodiment of the present invention includes an antenna case 410, an antenna base 420 housed in the antenna case 410, a cylindrical antenna 430-5 which is fixed to the antenna base 420 through a plurality of insulating spacers 426-5 and has a triangular section, and an amplifier circuit board 434. A length of the antenna case 410 in a longitudinal direction is set at about 200 mm. The antenna case 410 has a height of about 70 mm or less.

The configurations of the antenna case 410 and the antenna base 420 are the same as those in the fifth embodiment, and a description thereof will be omitted. However, the two insulating spacers 426-5 are upright formed on the antenna base 420, and the cylindrical antenna 430-5 having a triangular section is upright fixed to the distal end of the insulating spacer 426-5. The antenna 430-5 is formed by folding a metal plate or cutting a metal cylindrical bar having a triangular section. Both inclined planes of the antenna 430-5 facing the internal surface of the antenna case 410 are curved surfaces which are narrowed on the inside depending on the shape of the internal surface of the antenna case 410. Since the antenna 430-5 and the amplifier circuit board 434 are fixed to the antenna base 420, the metal antenna base 420 is fixed to the lower surface of the antenna case 410 to make it possible to house the antenna 430-5 and the amplifier circuit board 434 in the space of the antenna case 410.

The configuration of the amplifier circuit board 434 is also the same as that of the fifth embodiment, and a description thereof will be omitted. However, an antenna coil 432 to resonate the antenna 430-5 in an FM band is inserted between a feeding point of the antenna 430-5 and an input of an amplifier unit arranged on the amplifier circuit board 434. In the amplifier unit, received signals for an FM broadcast and an AM broadcast received by the antenna unit including the antenna 430-5 and the antenna coil 432 are separated from each other and amplified by amplifiers and output. An equivalent circuit diagram of the antenna apparatus 401-5 according to the ninth embodiment of the present invention is the same as the equivalent circuit diagram of the antenna apparatus 1 according to the first embodiment shown in FIG. 14.

Figure 51:
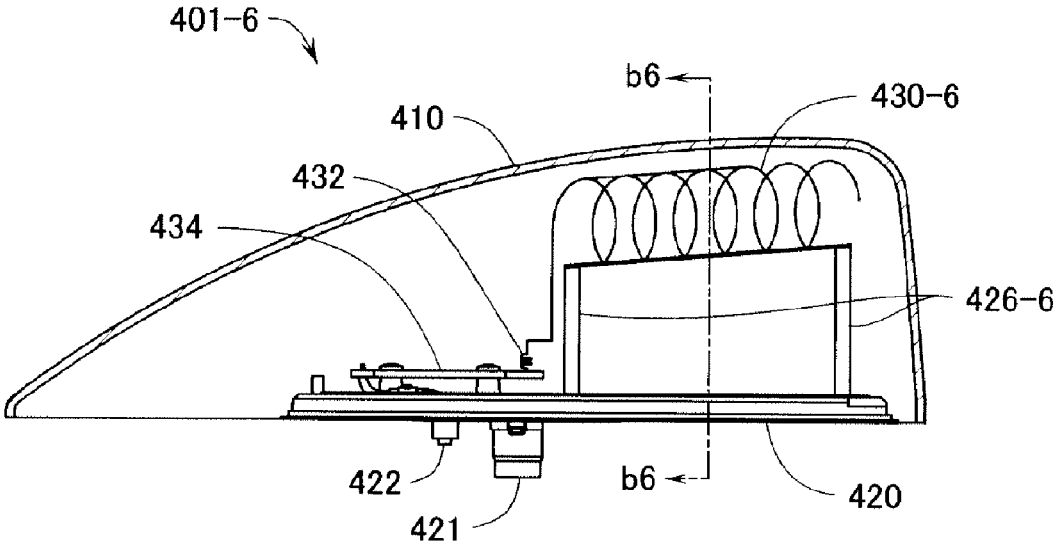
FIG. 51 is a side view showing the configuration of the antenna apparatus according to the tenth embodiment of the present invention.
Figure 52:
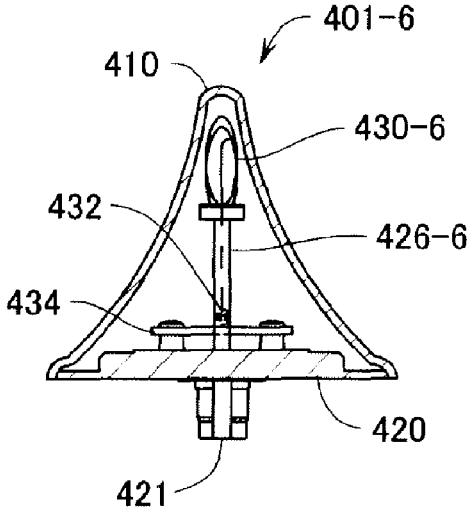
FIG. 52 is a front view showing a section obtained by cutting the configuration of the antenna apparatus according to the tenth embodiment of the present invention.

A configuration of an antenna apparatus according to a tenth embodiment is shown in FIGS. 51 and 52. FIG. 51 is a sectional view showing a configuration of an antenna apparatus 401-6 according to the tenth embodiment of the present invention, and FIG. 52 is a front view showing a section obtained by cutting the configuration of the antenna apparatus 401-6 according to the tenth embodiment of the present invention along a b6-b6 line.

As shown in these drawings, the antenna apparatus 401-6 according to the tenth embodiment of the present invention includes an antenna case 410, an antenna base 420 housed in the antenna case 410, a helically wound antenna 430-6 which is fixed to the antenna base 420 through a plurality of insulating spacers 426-6, and an amplifier circuit board 434. A length of the antenna case 410 in a longitudinal direction is set at about 200 mm. The antenna case 410 has a height of about 70 mm or less.

The configurations of the antenna case 410 and the antenna base 420 are the same as those in the fifth embodiment, and a description thereof will be omitted. However, the two insulating spacers 426-6 are upright formed on the antenna base 420, and a support member which supports a lower end of the helical antenna 430-6 is fixed to the distal end of the insulating spacer 426-6. The antenna 430-6 is formed by helically winding a metal line. Since the antenna 430-6 and the amplifier circuit board 434 are fixed to the antenna base 420, the metal antenna base 420 is fixed to the lower surface of the antenna case 410 to make it possible to house the antenna 430-6 and the amplifier circuit board 434 in the space of the antenna case 410.

The configuration of the amplifier circuit board 434 is also the same as that of the fifth embodiment, and a description thereof will be omitted. However, an antenna coil 432 to resonate the antenna 430-6 in an FM band is inserted between a feeding point of the antenna 430-6 and an input of an amplifier unit arranged on the amplifier circuit board 434. In the amplifier unit, received signals for an FM broadcast and an AM broadcast received by the antenna unit including the antenna 430-6 and the antenna coil 432 are separated from each other and amplified by amplifiers and output. An equivalent circuit diagram of the antenna apparatus 401-6 according to the tenth embodiment of the present invention is the same as the equivalent circuit diagram of the antenna apparatus 1 according to the first embodiment shown in FIG. 14.

Figure 53:
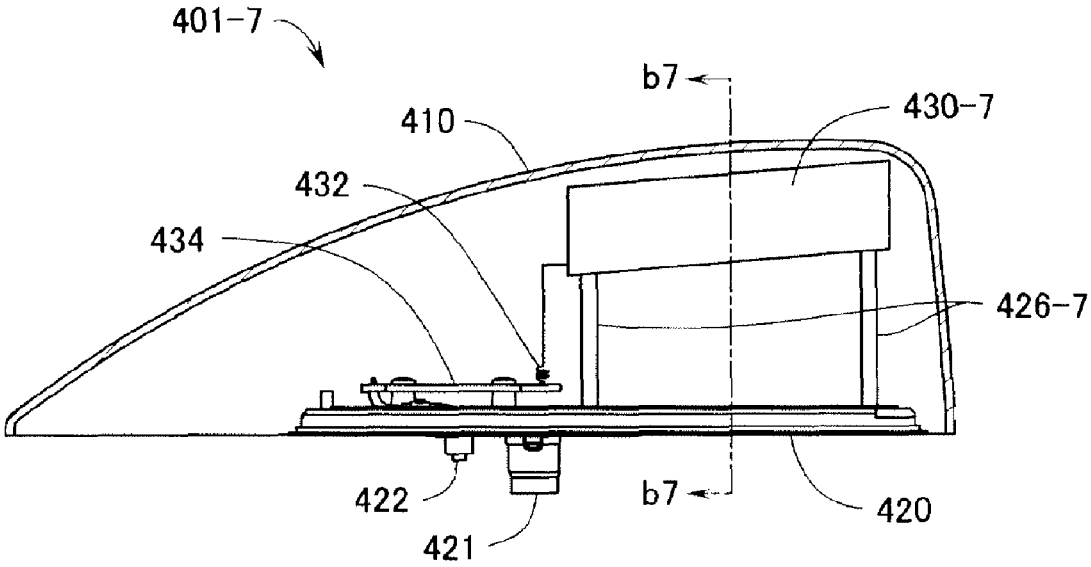
FIG. 53 is a side view showing the configuration of the antenna apparatus according to the eleventh embodiment of the present invention.
Figure 54:
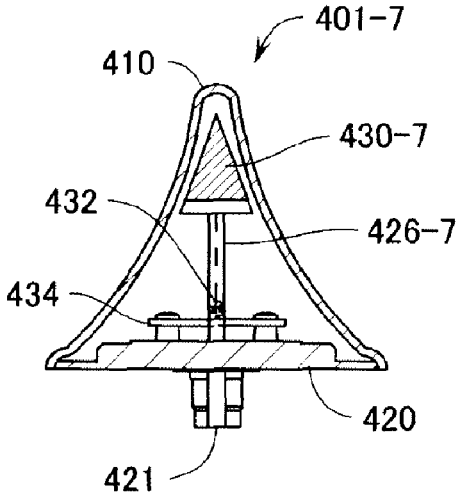
FIG. 54 is a front view showing a section obtained by cutting the configuration of the antenna apparatus according to the eleventh embodiment of the present invention.

A configuration of an antenna apparatus according to an eleventh embodiment is shown in FIGS. 53 and 54. FIG. 53 is a sectional view showing a configuration of an antenna apparatus 401-7 according to the eleventh embodiment of the present invention, and FIG. 54 is a front view showing a section obtained by cutting the configuration of the antenna apparatus 401-7 according to the eleventh embodiment of the present invention along a b7-b7 line.

As shown in these drawings, the antenna apparatus 401-7 according to the eleventh embodiment of the present invention includes an antenna case 410, an antenna base 420 housed in the antenna case 410, a bar-like antenna 430-7 which is fixed to the antenna base 420 through a plurality of insulating spacers 426-7 and has a triangular section, and an amplifier circuit board 434. A length of the antenna case 410 in a longitudinal direction is set at about 200 mm. The antenna case 410 has a height of about 70 mm or less.

The configurations of the antenna case 410 and the antenna base 420 are the same as those in the fifth embodiment, and a description thereof will be omitted. However, the two insulating spacers 426-7 are upright formed on the antenna base 420, and the bar-like antenna 430-7 having a triangular section is upright fixed to the distal end of the insulating spacer 426-7. The antenna 430-7 is formed by processing a metal bar or depositing or sticking a metal material to the entire surface of an insulating bar having a triangular section. Since the antenna 430-7 and the amplifier circuit board 434 are fixed to the antenna base 420, the metal antenna base 420 is fixed to the lower surface of the antenna case 410 to make it possible to house the antenna 430-7 and the amplifier circuit board 434 in the antenna case 410.

The configuration of the amplifier circuit board 434 is also the same as that of the fifth embodiment, and a description thereof will be omitted. However, an antenna coil 432 to resonate the antenna 430-7 in an FM band is inserted between a feeding point of the antenna 430-7 and an input of an amplifier unit arranged on the amplifier circuit board 434. In the amplifier unit, received signals for an FM broadcast and an AM broadcast received by the antenna unit including the antenna 430-7 and the antenna coil 432 are separated from each other and amplified by amplifiers and output. An equivalent circuit diagram of the antenna apparatus 401-7 according to the eleventh embodiment of the present invention is the same as the equivalent circuit diagram of the antenna apparatus 1 according to the first embodiment shown in FIG. 14.

Figure 55:
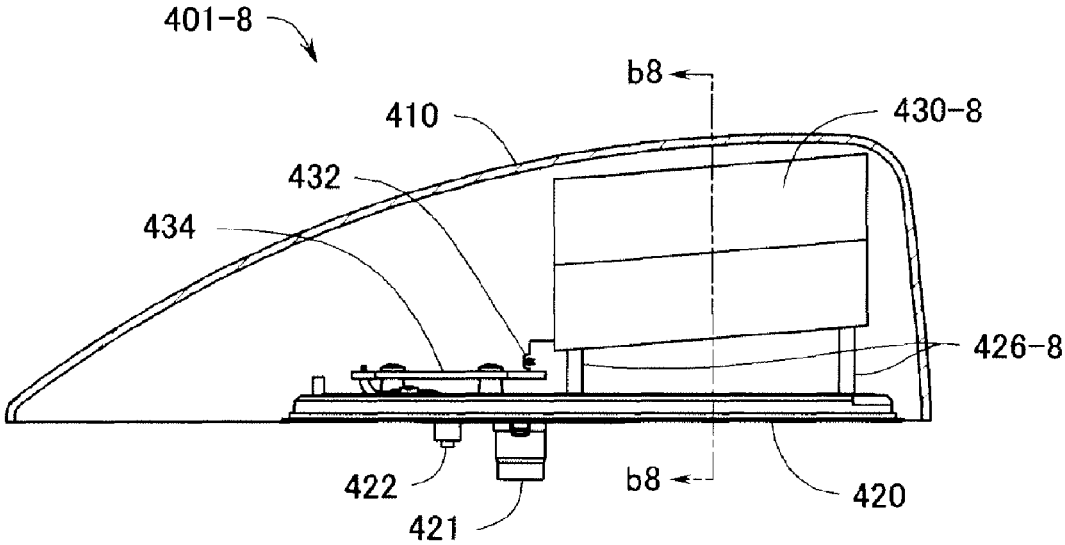
FIG. 55 is a side view showing the configuration of the antenna apparatus according to the twelfth embodiment of the present invention.
Figure 56:
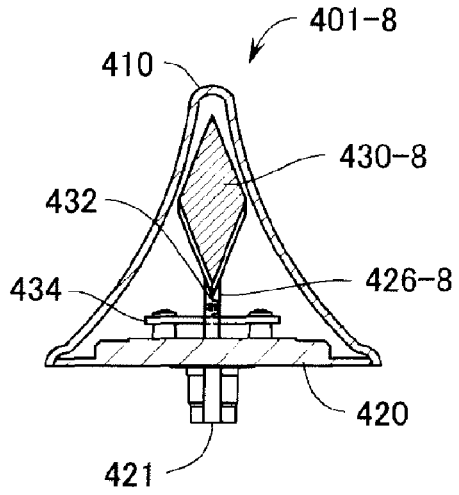
FIG. 56 is a front view showing a section obtained by cutting the configuration of the antenna apparatus according to the twelfth embodiment of the present invention.

A configuration of an antenna apparatus according to a twelfth embodiment is shown in FIGS. 55 and 56. FIG. 55 is a sectional view showing a configuration of an antenna apparatus 401-8 according to the twelfth embodiment of the present invention, and FIG. 56 is a front view showing a section obtained by cutting the configuration of the antenna apparatus 401-8 according to the twelfth embodiment of the present invention along a b8-b8 line.

As shown in these drawings, the antenna apparatus 401-8 according to the twelfth embodiment of the present invention includes an antenna case 410, an antenna base 420 housed in the antenna case 410, a bar-like antenna 430-8 which is fixed to the antenna base 420 through a plurality of insulating spacers 426-8 and has a rhomboid-shaped section, and an amplifier circuit board 434. A length of the antenna case 410 in a longitudinal direction is set at about 200 mm. The antenna case 410 has a height of about 70 mm or less. As shown in the drawings, the antenna apparatus 401-8 according to the twelfth embodiment corresponds to a modification obtained by enlarging the antenna 430-2 having the rhomboid-shaped section in the antenna apparatus 401-2 according to the sixth embodiment.

The configurations of the antenna case 410 and the antenna base 420 are the same as those in the fifth embodiment, and a description thereof will be omitted. However, the two insulating spacers 426-8 are upright formed on the antenna base 420, and the bar-like antenna 430-8 having a rhomboid-shaped section is upright fixed to the distal end of the insulating spacer 426-8. The antenna 430-8 is formed by processing a metal bar or depositing or sticking a metal material to the entire surface of an insulating bar having a rhomboid-shaped section. Since the antenna 430-8 and the amplifier circuit board 434 are fixed to the antenna base 420, the metal antenna base 420 is fixed to the lower surface of the antenna case 410 to make it possible to house the antenna 430-8 and the amplifier circuit board 434 in the space of the antenna case 410.

The configuration of the amplifier circuit board 434 is also the same as that of the fifth embodiment, and a description thereof will be omitted. However, an antenna coil 432 to resonate the antenna 430-8 in an FM band is inserted between a feeding point of the antenna 430-8 and an input of an amplifier unit arranged on the amplifier circuit board 434. In the amplifier unit, received signals for an FM broadcast and an AM broadcast received by the antenna unit including the antenna 430-8 and the antenna coil 432 are separated from each other and amplified by amplifiers and output. An equivalent circuit diagram of the antenna apparatus 401-8 according to the twelfth embodiment of the present invention is the same as the equivalent circuit diagram of the antenna apparatus 1 according to the first embodiment shown in FIG. 14.

Figure 57:
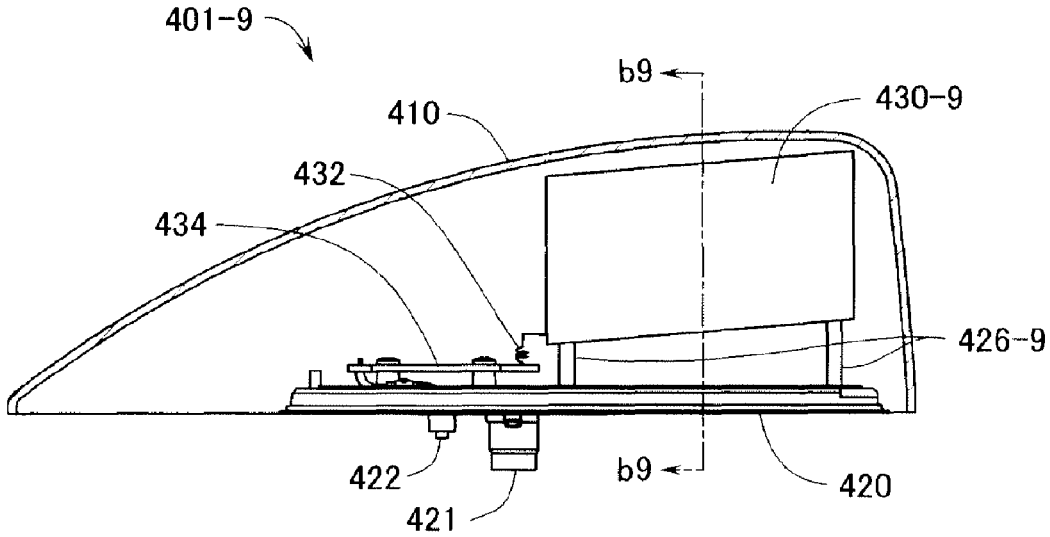
FIG. 57 is a side view showing the configuration of the antenna apparatus according to the thirteenth embodiment of the present invention.
Figure 58:
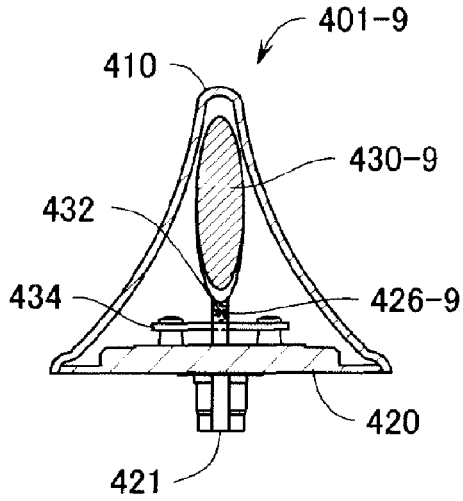
FIG. 58 is a front view showing a section obtained by cutting the configuration of the antenna apparatus according to the thirteenth embodiment of the present invention.

A configuration of an antenna apparatus according to a thirteenth embodiment is shown in FIGS. 57 and 58. FIG. 57 is a sectional view showing a configuration of an antenna apparatus 401-9 according to the thirteenth embodiment of the present invention, and FIG. 58 is a front view showing a section obtained by cutting the configuration of the antenna apparatus 401-9 according to the thirteenth embodiment of the present invention along a b9-b9 line.

As shown in these drawings, the antenna apparatus 401-9 according to the thirteenth embodiment of the present invention includes an antenna case 410, an antenna base 420 housed in the antenna case 410, a bar-like antenna 430-9 which is fixed to the antenna base 420 through a plurality of insulating spacers 426-9 and has an elliptical section, and an amplifier circuit board 434. A length of the antenna case 410 in a longitudinal direction is set at about 200 mm. The antenna case 410 has a height of about 70 mm or less. As shown in the drawings, the antenna apparatus 401-9 according to the thirteenth embodiment corresponds to a modification obtained by enlarging the antenna 430-3 having the rhomboid-shaped section in the antenna apparatus 401-3 according to the seventh embodiment.

The configurations of the antenna case 410 and the antenna base 420 are the same as those in the fifth embodiment, and a description thereof will be omitted. However, the two insulating spacers 426-9 are upright formed on the antenna base 420, and the bar-like antenna 430-9 having an elliptical section is upright fixed to the distal end of the insulating spacer 426-9. The antenna 430-9 is formed by processing a metal bar or depositing or sticking a metal material to an entire surface of an insulating bar having an elliptical section. Since the antenna 430-9 and the amplifier circuit board 434 are fixed to the antenna base 420, the metal antenna base 420 is fixed to the lower surface of the antenna case 410 to make it possible to house the antenna 430-9 and the amplifier circuit board 434 in the space of the antenna case 410.

The configuration of the amplifier circuit board 434 is also the same as that of the fifth embodiment, and a description thereof will be omitted. However, an antenna coil 432 to resonate the antenna 430-9 in an FM band is inserted between a feeding point of the antenna 430-9 and an input of an amplifier unit arranged on the amplifier circuit board 434. In the amplifier unit, received signals for an FM broadcast and an AM broadcast received by the antenna unit including the antenna 430-9 and the antenna coil 432 are separated from each other and amplified by amplifiers and output. An equivalent circuit diagram of the antenna apparatus 401-9 according to the thirteenth embodiment of the present invention is the same as the equivalent circuit diagram of the antenna apparatus 1 according to the first embodiment shown in FIG. 14.

Figure 59:
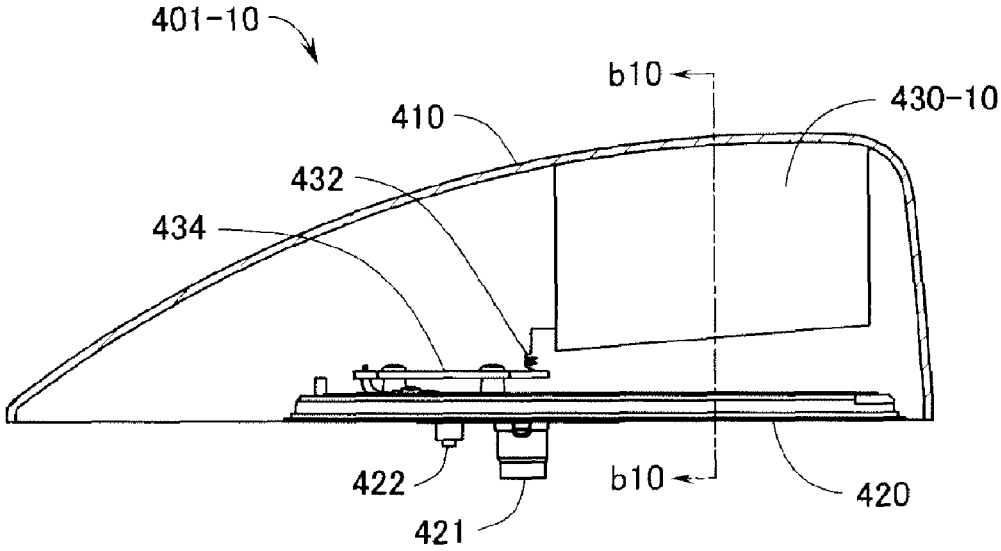
FIG. 59 is a side view showing the configuration of the antenna apparatus according to the fourteenth embodiment of the present invention.
Figure 60:
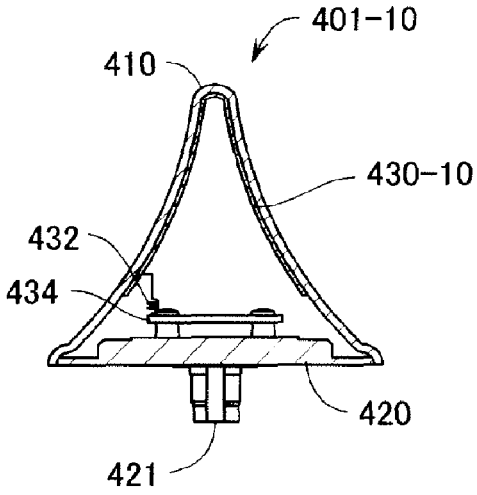
FIG. 60 is a front view showing a section obtained by cutting the configuration of the antenna apparatus according to the fourteenth embodiment of the present invention.

A configuration of an antenna apparatus according to a fourteenth embodiment is shown in FIGS. 59 and 60. FIG. 59 is a sectional view showing a configuration of an antenna apparatus 401-10 according to the fourteenth embodiment of the present invention, and FIG. 60 is a front view showing a section obtained by cutting the configuration of the antenna apparatus 401-10 according to the fourteenth embodiment of the present invention along a b10-b10 line.

As shown in these drawings, the antenna apparatus 401-10 according to the fourteenth embodiment of the present invention includes an antenna case 410, an antenna base 420 housed in the antenna case 410, a planar antenna 430-10 which is arranged on an internal surface except for the lower portion of the antenna case 410, and an amplifier circuit board 434. A length of the antenna case 410 in a longitudinal direction is set at about 200 mm. The antenna case 410 has a height of about 70 mm or less.

The configurations of the antenna case 410 and the antenna base 420 are the same as those in the fifth embodiment, and a description thereof will be omitted. However, the planar antenna 430-10 obtained by depositing or sticking a metal material on an internal surface of the antenna case 410 except for the lower portion of the antenna case 410 is arranged on the internal surface of the antenna case 410. Since the amplifier circuit board 434 is fixed to the antenna base 420, the metal antenna base 420 is fixed to the lower surface of the antenna case 410 to make it possible to house the antenna 430-10 and the amplifier circuit board 434 in the space of the antenna case 410.

The configuration of the amplifier circuit board 434 is also the same as that of the fifth embodiment, and a description thereof will be omitted. However, an antenna coil 432 to resonate the antenna 430-10 in an FM band is inserted between a feeding point of the antenna 430-10 and an input of an amplifier unit arranged on the amplifier circuit board 434. In the amplifier unit, received signals for an FM broadcast and an AM broadcast received by the antenna unit including the antenna 430-10 and the antenna coil 432 are separated from each other and amplified by amplifiers and output. An equivalent circuit diagram of the antenna apparatus 401-10 according to the fourteenth embodiment of the present invention is the same as the equivalent circuit diagram of the antenna apparatus 1 according to the first embodiment shown in FIG. 14.

Figure 61:
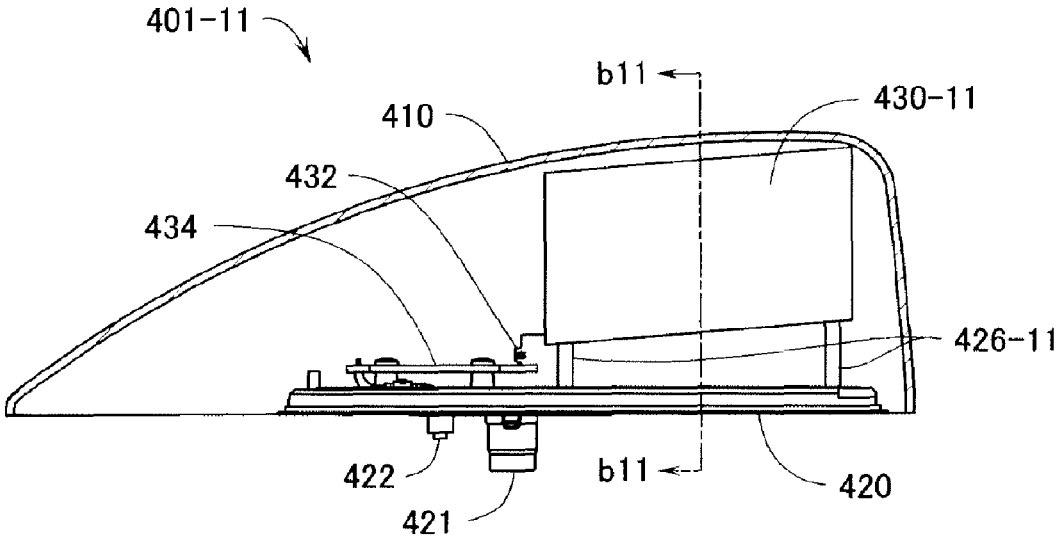
FIG. 61 is a side view showing the configuration of the antenna apparatus according to the fifteenth embodiment of the present invention.
Figure 62:
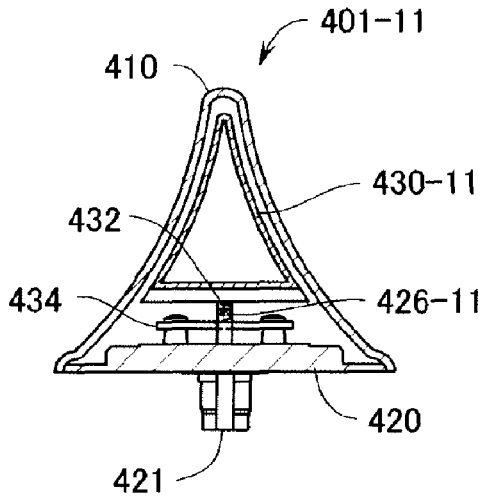
FIG. 62 is a front view showing a section obtained by cutting the configuration of the antenna apparatus according to the fifteenth embodiment of the present invention.

A configuration of an antenna apparatus according to a fifteenth embodiment is shown in FIGS. 61 and 62. FIG. 61 is a sectional view showing a configuration of an antenna apparatus 401-11 according to the fifteenth embodiment of the present invention, and FIG. 62 is a front view showing a section obtained by cutting the configuration of the antenna apparatus 401-11 according to the fifteenth embodiment of the present invention along a b11-b11 line.

As shown in these drawings, the antenna apparatus 401-11 according to the fifteenth embodiment of the present invention includes an antenna case 410, an antenna base 420 housed in the antenna case 410, a cylindrical antenna 430-11 which is fixed to the antenna base 420 through a plurality of insulating spacers 426-11 and has a triangular section, and an amplifier circuit board 434. A length of the antenna case 410 in a longitudinal direction is set at about 200 mm. The antenna case 410 has a height of about 70 mm or less. As shown in the drawings, the antenna apparatus 401-11 according to the fifteenth embodiment corresponds to a modification obtained by enlarging the cylindrical antenna 430-5 having the triangular section in the antenna apparatus 401-5 according to the ninth embodiment.

The configurations of the antenna case 410 and the antenna base 420 are the same as those in the fifth embodiment, and a description thereof will be omitted. However, the two insulating spacers 426-11 are upright formed on the antenna base 420, and the cylindrical antenna 430-11 having a triangular section is upright fixed to the distal end of the insulating spacer 426-11. The antenna 430-11 is formed by folding a metal plate or cutting a metal cylindrical bar having a circular section. Both inclined planes of the antenna 430-11 facing the internal surface of the antenna case 410 are curved surfaces which are narrowed on the inside depending on the shape of the internal surface of the antenna case 410. Since the antenna 430-11 and the amplifier circuit board 434 are fixed to the antenna base 420, the metal antenna base 420 is fixed to the lower surface of the antenna case 410 to make it possible to house the antenna 430-11 and the amplifier circuit board 434 in the space of the antenna case 410.

The configuration of the amplifier circuit board 434 is also the same as that of the fifth embodiment, and a description thereof will be omitted. However, an antenna coil 432 to resonate the antenna 430-11 in an FM band is inserted between a feeding point of the antenna 430-11 and an input of an amplifier unit arranged on the amplifier circuit board 434. In the amplifier unit, received signals for an FM broadcast and an AM broadcast received by the antenna unit including the antenna 430-11 and the antenna coil 432 are separated from each other and amplified by amplifiers and output. An equivalent circuit diagram of the antenna apparatus 401-11 according to the fifteenth embodiment of the present invention is the same as the equivalent circuit diagram of the antenna apparatus 1 according to the first embodiment shown in FIG. 14.

Figure 63:
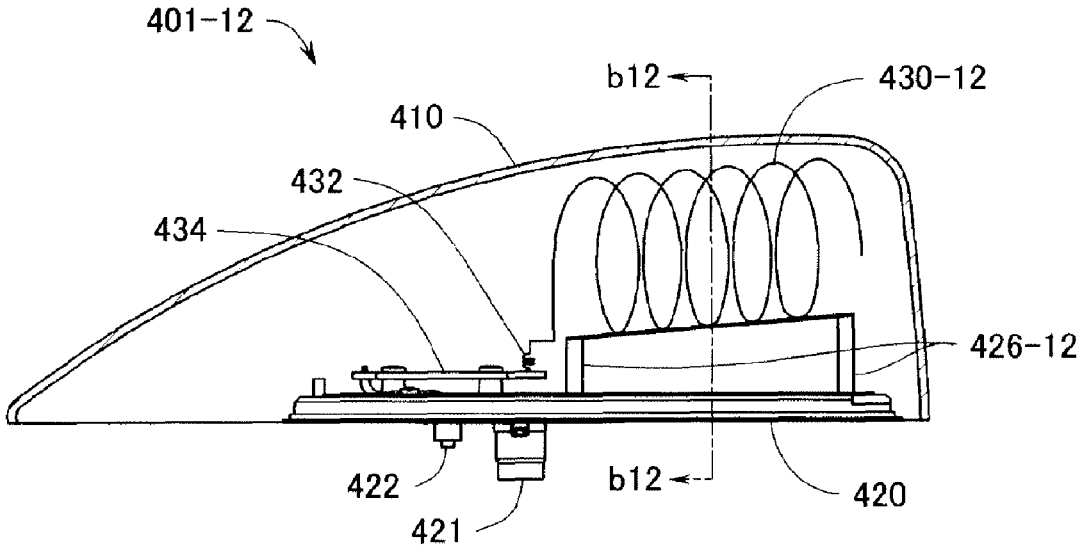
FIG. 63 is a side view showing the configuration of the antenna apparatus according to the sixteenth embodiment of the present invention.
Figure 64:
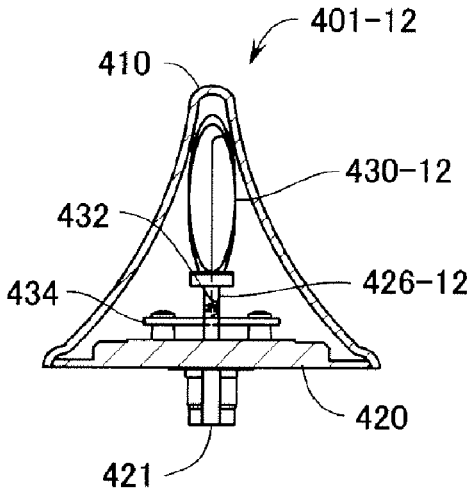
FIG. 64 is a front view showing a section obtained by cutting the configuration of the antenna apparatus according to the sixteenth embodiment of the present invention.

A configuration of an antenna apparatus according to a sixteenth embodiment is shown in FIGS. 63 and 64. FIG. 63 is a sectional view showing a configuration of an antenna apparatus 401-12 according to the sixteenth embodiment of the present invention, and FIG. 64 is a front view showing a section obtained by cutting the configuration of the antenna apparatus 401-12 according to the sixteenth embodiment of the present invention along a b12-b12 line.

As shown in these drawings, the antenna apparatus 401-12 according to the sixteenth embodiment of the present invention includes an antenna case 410, an antenna base 420 housed in the antenna case 410, a helically wound antenna 430-12 which is fixed to the antenna base 420 through a plurality of insulating spacers 426-12, and an amplifier circuit board 434. A length of the antenna case 410 in a longitudinal direction is set at about 200 mm. The antenna case 410 has a height of about 70 mm or less. As shown in the drawings, the antenna apparatus 401-12 according to the sixteenth embodiment corresponds to a modification obtained by enlarging the helical antenna 430-6 in the antenna apparatus 401-6 according to the tenth embodiment.

The configurations of the antenna case 410 and the antenna base 420 are the same as those in the fifth embodiment, and a description thereof will be omitted. However, the two insulating spacers 426-12 are upright formed on the antenna base 420, and a support member which supports a lower end of the helical antenna 430-12 is fixed to the distal end of the insulating spacer 426-12. The antenna 430-12 is formed by helically winding a metal line. Since the antenna 430-12 and the amplifier circuit board 434 are fixed to the antenna base 420, the metal antenna base 420 is fixed to the lower surface of the antenna case 410 to make it possible to house the antenna 430-12 and the amplifier circuit board 434 in the space of the antenna case 410.

The configuration of the amplifier circuit board 434 is also the same as that of the fifth embodiment, and a description thereof will be omitted. However, an antenna coil 432 to resonate the antenna 430-12 in an FM band is inserted between a feeding point of the antenna 430-12 and an input of an amplifier unit arranged on the amplifier circuit board 434. In the amplifier unit, received signals for an FM broadcast and an AM broadcast received by the antenna unit including the antenna 430-12 and the antenna coil 432 are separated from each other and amplified by amplifiers and output. An equivalent circuit diagram of the antenna apparatus 401-12 according to the sixteenth embodiment of the present invention is the same as the equivalent circuit diagram of the antenna apparatus 1 according to the first embodiment shown in FIG. 14.

Figure 65:
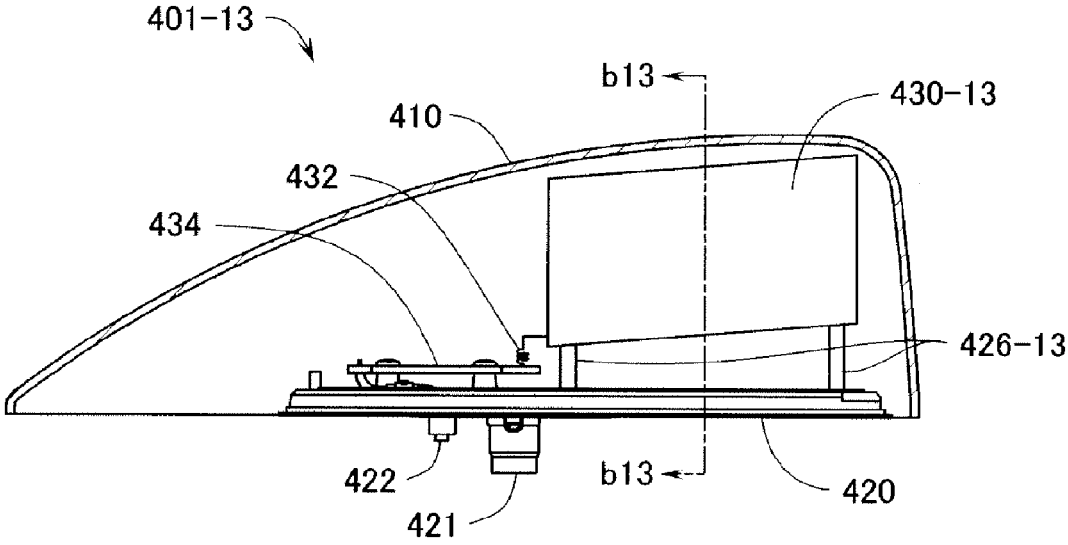
FIG. 65 is a side view showing the configuration of the antenna apparatus according to the seventeenth embodiment of the present invention.
Figure 66:
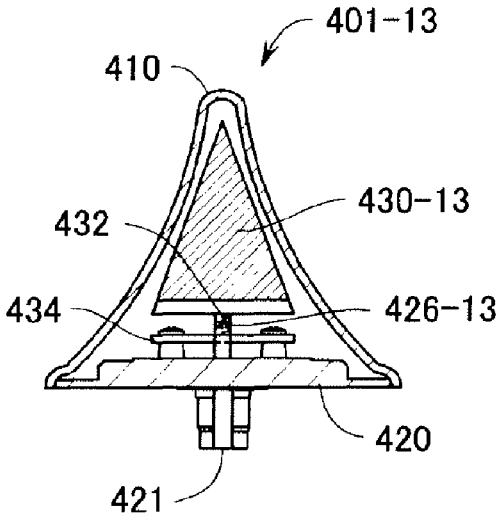
FIG. 66 is a front view showing a section obtained by cutting the configuration of the antenna apparatus according to the seventeenth embodiment of the present invention.
Figure 67:
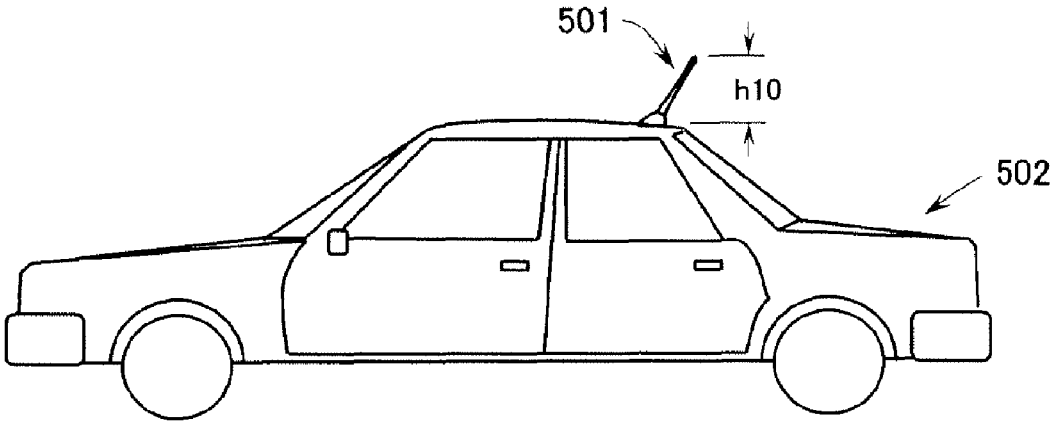
FIG. 67 Prior art
FIG. 67 is a diagram showing a configuration in which a prior antenna apparatus is attached to a vehicle.

A configuration of an antenna apparatus according to a seventeenth embodiment is shown in FIGS. 65 and 66. FIG. 65 is a sectional view showing a configuration of an antenna apparatus 401-13 according to the seventeenth embodiment of the present invention, and FIG. 66 is a front view showing a section obtained by cutting the configuration of the antenna apparatus 401-13 according to the seventeenth embodiment of the present invention along a b13-b13 line.

As shown in these drawings, the antenna apparatus 401-13 according to the seventeenth embodiment of the present invention includes an antenna case 410, an antenna base 420 housed in the antenna case 410, a bar-like antenna 430-13 which is fixed to the antenna base 420 through a plurality of insulating spacers 426-13 and has a triangular section, and an amplifier circuit board 434. A length of the antenna case 410 in a longitudinal direction is set at about 200 mm. The antenna case 410 has a height of about 70 mm or less. As shown in the drawings, the antenna apparatus 401-13 according to the seventeenth embodiment corresponds to a modification obtained by enlarging the bar-like antenna 430-7 having the triangular section in the antenna apparatus 401-7 according to the eleventh embodiment.

The configurations of the antenna case 410 and the antenna base 420 are the same as those in the fifth embodiment, and a description thereof will be omitted. However, the two insulating spacers 426-13 are upright formed on the antenna base 420, and the bar-like antenna 430-13 having a triangular section is upright fixed to the distal end of the insulating spacer 426-13. The antenna 430-13 is formed by processing a metal bar or depositing or sticking a metal material to the entire surface of an insulating bar having a triangular section. Since the antenna 430-13 and the amplifier circuit board 434 are fixed to the antenna base 420, the metal antenna base 420 is fixed to the lower surface of the antenna case 410 to make it possible to house the antenna 430-13 and the amplifier circuit board 434 in the space of the antenna case 410.

The configuration of the amplifier circuit board 434 is also the same as that of the fifth embodiment, and a description thereof will be omitted. However, an antenna coil 432 to resonate the antenna 430-13 in an FM band is inserted between a feeding point of the antenna 430-13 and an input of an amplifier unit arranged on the amplifier circuit board 434. In the amplifier unit, received signals for an FM broadcast and an AM broadcast received by the antenna unit including the antenna 430-13 and the antenna coil 432 are separated from each other and amplified by amplifiers and output. An equivalent circuit diagram of the antenna apparatus 401-13 according to the seventeenth embodiment of the present invention is the same as the equivalent circuit diagram of the antenna apparatus 1 according to the first embodiment shown in FIG. 14.

INDUSTRIAL APPLICABILITY

In each of the antenna apparatuses according to the present invention described above, an antenna pattern is arranged at a high position to be set apart from the ground as much as possible, and the antenna pattern 31 occupies a large area, so that a good electric characteristic in the frequency band for FM broadcast and in the frequency band for AM broadcast can be obtained. In this case, a flat conductor plate uprightly arranged in place of an antenna pattern can also be used as an antenna. An interval between a lower edge of the conductor plate and the ground is preferably set at about 10 mm or more. When the uprightly arranged flat conductor plate is bent in a U shape or the like to increase the volume of the conductor, the electric characteristic can be more improved. Furthermore, the antenna may have a rod-like shape or may be helical. The rod-like antenna is constituted of a bar-like or cylindrical conductor (for example, a metal), and a sectional shape thereof is circular, elliptical, or polygonal. The antenna is connected to a feeding point through an antenna coil. When the helical or rod-like antenna is used, the antenna is arranged along an upper internal end of an antenna case to make an interval S between the ground and the rod-like antenna 10 mm or more. Therefore, electric characteristics of the antenna apparatus can be improved.

The length of the antenna according to each of the embodiments of the present invention is about 60 mm, at most, about 90 mm. When a wavelength at a frequency of 100 MHz in an FM band is represented by $\lambda$, $0.03\lambda$ is equal to the dimension of about 90 mm, and the length of the antenna is about 1/30 wavelength or less.

Furthermore, an umbrella top extending to both the ends can be arranged on an upper end of the antenna pattern in the antenna apparatus according to the second to fourth embodiments. In addition, in the antenna apparatus according to the first to fourth embodiments, in place of the arrangement of the umbrella top extending to both the end at the upper end of the antenna pattern, an antenna unit may be constituted by only the umbrella top and an antenna coil without using an antenna pattern. In this case, the umbrella top is fixed to an internal upper surface of an antenna case by adhesion or the like to make it possible to omit the antenna circuit board.

Furthermore, an umbrella top extending to both the ends can be arranged on an upper end of the antenna pattern in each of the antenna circuit boards shown in FIGS. 36 to 40. In this case, in place of the arrangement of the umbrella top extending to both the end at the upper end of the antenna pattern on each of the antenna circuit boards in FIGS. 36 to 40, an antenna unit may be constituted by only the umbrella top and an antenna coil without using an antenna pattern. In this case, the umbrella top is fixed to an internal upper surface of an antenna case by adhesion or the like to make it possible to omit the antenna circuit board.

An umbrella top is arranged on an upper internal portion of the antenna case by deposition, sticking, or the like, and antenna connection means is arranged, so that the umbrella top may be connected to the antenna when the antenna apparatus is housed in the antenna case.

Still furthermore, the antenna apparatus according to the present invention is for vehicle such that the antenna apparatus can be attached to the roof or trunk of a vehicle. However, the present invention can be applied to any antenna apparatus which receives at least an FM band signal.

The invention claimed is:

1. An antenna apparatus which can receive at least FM broadcast, comprising an antenna case projecting from a vehicle in a height of not more than about 70 mm when the antenna apparatus is attached to the vehicle and an antenna unit housed in the antenna case, wherein the antenna unit comprises:

a rectangular-shaped antenna, where an umbrella-like conductive layer extends along an upper periphery of the rectangular-shaped antenna; and an amplifier circuit board having an amplifier which amplifies at least an FM broadcast signal received by the antenna, wherein an interval between a lower edge of the antenna and a ground is not less than about 10 mm, and a feeding point of the antenna is connected to an input of the amplifier through an antenna coil.

2. The antenna apparatus which can receive at least FM broadcast, according to claim 1, wherein the antenna is a rod-like antenna arranged in the antenna case, and the rod-like antenna is constituted of a bar-like or cylindrical conductor having a circular section, an elliptical section, or a polygonal section.

3. The antenna apparatus which can receive at least FM broadcast, according to claim 1, wherein a length of the antenna is not more than about 1/30 a wavelength $\lambda$ of the FM broadcast, and an antenna unit including the antenna and the antenna coil almost resonate with the FM broadcast.

4. The antenna apparatus which can receive at least FM broadcast, according to claim 1, wherein the antenna case has a streamlined outer shape which is tapered off and decreased in height toward the distal end, and the amplifier circuit board is housed at a lower portion in the antenna case.

5. An antenna apparatus which can receive at least FM broadcast, comprising an antenna case projecting from a vehicle in a height of not more than about 70 mm when the antenna apparatus is attached to the vehicle, and an antenna unit housed in the antenna case, wherein the antenna unit comprises:

an antenna circuit board which is upright arranged and which has an antenna pattern formed thereon, wherein the antenna pattern has a rectangular-shaped antenna, where an umbrella-like conductive layer extends along an upper periphery of the rectangular-shaped antenna, and an amplifier circuit board having an amplifier which amplifies at least an FM broadcast signal received by the antenna pattern, wherein an interval between a lower edge of the antenna pattern and a ground is not less than about 10 mm, and a feeding point of the antenna pattern on the antenna circuit board is connected to an input of the amplifier on the amplifier circuit board through an antenna coil.

6. The antenna apparatus which can receive at least FM broadcast, according to claim 5, wherein means for permitting only a frequency band exceeding at least an FM band to pass therethrough is connected to the antenna pattern, and the antenna pattern is used as an antenna having a frequency band exceeding the FM band.

7. The antenna apparatus which can receive at least FM broadcast, according to claim 5, wherein another antenna pattern which can operate in a frequency band exceeding an FM band is formed on a lower portion on the antenna circuit board where the antenna pattern is not formed.

8. The antenna apparatus which can receive at least FM broadcast, according to claim 5, wherein the antenna unit further comprises another antenna circuit board on which another antenna pattern which can operate in a frequency band exceeding an FM band is formed.

9. The antenna apparatus which can receive at least FM broadcast, according to claim 5, wherein a length of the antenna pattern is not more than about $1/30$ a wavelength $\lambda$ of the FM broadcast, and the antenna unit including the antenna pattern and the antenna coil almost resonate with the FM broadcast.

10. The antenna apparatus which can receive at least FM broadcast, according to claim 5, wherein the antenna case has a streamlined outer shape which is tapered off and decreased in height toward the distal end, and the amplifier circuit board is housed at a lower portion in the antenna case.

* * * * *